US009960558B2

(12) United States Patent
Ocegueda Gallaga et al.

(10) Patent No.: US 9,960,558 B2
(45) Date of Patent: May 1, 2018

(54) POWERED TREE CONSTRUCTION

(71) Applicant: POLYGROUP MACAU LIMITED (BVI), Road Town, Tortola (VG)

(72) Inventors: Victor Hugo Ocegueda Gallaga, Tijuana (MX); Yifeng Zhang, Xinxiang (CN)

(73) Assignee: POLYGROUP MACAU LIMITED (BVI), Road Town, Tortola (VG)

( * ) Notice: Subject to any disclaimer, the term of this patent is extended or adjusted under 35 U.S.C. 154(b) by 0 days. days.

(21) Appl. No.: 15/446,701

(22) Filed: Mar. 1, 2017

(65) Prior Publication Data

US 2017/0256898 A1 Sep. 7, 2017

Related U.S. Application Data

(60) Provisional application No. 62/303,521, filed on Mar. 4, 2016.

(51) Int. Cl.

| | |
|---|---|
| ***H01R 13/60*** | (2006.01) |
| ***H01R 33/20*** | (2006.01) |
| ***A47G 33/06*** | (2006.01) |
| ***H01R 13/72*** | (2006.01) |

(52) U.S. Cl.
CPC ..... *H01R 33/205* (2013.01); *A47G 33/06* (2013.01); *H01R 13/72* (2013.01)

(58) Field of Classification Search
CPC ..... A41G 1/007; A47G 33/06; A47G 33/04; H01R 24/38; H01R 13/72
USPC ..... 439/533, 620.21, 148; 428/20
See application file for complete search history.

(56) References Cited

U.S. PATENT DOCUMENTS

| | | | | |
|---|---|---|---|---|
| 2,188,529 A * | 1/1940 | Corina | A47G 33/06 174/71 R |
| 2,806,938 A | 9/1957 | Henry | |
| 3,118,617 A * | 1/1964 | Hellrich | H01R 33/00 315/191 |
| 3,460,087 A * | 8/1969 | Stapf | H01R 33/205 439/56 |

(Continued)

OTHER PUBLICATIONS

Extended European Search Report dated Aug. 8, 2017 for corresponding application No. 17159225.6.

*Primary Examiner* — Abdullah Riyami
*Assistant Examiner* — Vladimir Imas
(74) *Attorney, Agent, or Firm* — Troutman Sanders LLP; Ryan A. Schneider; Christopher C. Close, Jr.

(57) ABSTRACT

A power transfer system to facilitate the transfer of electrical power between tree trunk sections of an artificial tree is disclosed. The power transfer system can advantageously enable neighboring tree trunk sections to be electrically connected without the need to rotationally align the tree trunk sections. Power distribution subsystems can be partially disposed within the trunk sections. The power distribution subsystems can comprise a male end, a female end, or both. The male ends can have prongs and the female ends can have channels, and the prongs and channels may be positioned outside of the trunk sections. The prongs can be inserted into the channels to electrically connect the power distribution subsystems of neighboring tree trunk sections. The prongs and channels may be configured to engage one another without the need to rotationally align the tree trunk sections.

16 Claims, 24 Drawing Sheets

(56) References Cited

U.S. PATENT DOCUMENTS 3,659,249 A * 4/1972 Dupree ..... H01R 33/205 340/318
3,757,270 A * 9/1973 Dupree ..... H01R 33/205 362/396
3,909,096 A * 9/1975 Brzozowski ..... H01R 33/205 439/272
4,076,358 A * 2/1978 Taormina ..... H01R 33/205 439/547
5,061,189 A * 10/1991 Iio ..... H01R 33/09 439/547
5,776,559 A * 7/1998 Woolford ..... A47G 33/06 362/123
6,244,724 B1 * 6/2001 Schemm ..... F21S 8/00 362/216
8,053,042 B1 * 11/2011 Loomis ..... A47G 33/06 362/123
8,298,633 B1 * 10/2012 Chen ..... A47G 33/06 248/512
8,309,188 B2 * 11/2012 Cheng ..... A47G 33/06 229/117.27
8,454,186 B2 6/2013 Chen
8,454,187 B2 6/2013 Chen
8,753,152 B1 * 6/2014 Tsai ..... A47G 33/06 362/202
8,776,413 B2 * 7/2014 Willett ..... A63J 5/028 40/410
8,863,416 B2 * 10/2014 Leung ..... A47G 33/06 40/442
8,870,404 B1 10/2014 Chen
8,916,242 B2 * 12/2014 Fu ..... A41G 1/007 285/330
8,936,379 B1 1/2015 Chen
8,956,183 B2 * 2/2015 Tsai ..... H01R 24/28 439/540.1
8,959,810 B1 2/2015 Leung et al.
8,974,072 B2 3/2015 Chen
9,044,056 B2 * 6/2015 Chen ..... A41G 1/005
9,066,617 B2 6/2015 Chen
9,119,495 B2 9/2015 Leung et al.
9,125,508 B2 * 9/2015 Loomis ..... A47G 33/06
9,140,438 B2 * 9/2015 Chen ..... F21V 23/001
9,179,793 B2 11/2015 Chen
9,209,546 B1 12/2015 Gibboney, Jr.
9,220,361 B1 12/2015 Chen
9,276,364 B2 * 3/2016 Mitsuno ..... H01R 24/50
9,431,765 B2 8/2016 Tao
9,439,528 B2 * 9/2016 Chen ..... A47G 33/06
9,484,687 B1 11/2016 Chen
9,526,286 B2 12/2016 Chen
9,572,446 B2 * 2/2017 Chen ..... A47G 33/06
9,577,376 B1 2/2017 Tsai
9,648,919 B2 5/2017 Chen
9,671,074 B2 6/2017 Chen
9,677,748 B1 * 6/2017 Chen ..... F21V 23/003
9,839,315 B2 12/2017 Leung et al.
9,843,147 B2 12/2017 Leung et al.
9,844,288 B2 12/2017 Fu et al.
9,861,147 B1 1/2018 Chen
9,883,706 B2 2/2018 Chen
2006/0164834 A1 7/2006 Kao
2007/0230174 A1 10/2007 Hicks et al.
2011/0211364 A1 9/2011 Lutz et al.
2013/0108808 A1 5/2013 Leung et al.
2013/0301245 A1 11/2013 Chen
2013/0301247 A1 11/2013 Chen
2015/0029703 A1 1/2015 Chen
2017/0040755 A1 2/2017 Leung et al.
2017/0042358 A1 2/2017 Chen
2017/0164774 A1 6/2017 Chen
2017/0164775 A1 6/2017 Chen
2017/0181561 A1 6/2017 Chen
2017/0238639 A1 8/2017 Chen
2017/0311744 A1 11/2017 Chen

* cited by examiner

POWERED TREE CONSTRUCTION

CROSS-REFERENCE TO RELATED APPLICATIONS

This application claims benefit under 35 U.S.C. § 119(e) of U.S. Provisional Patent Application No. 62/303,521, filed Mar. 4, 2016, and entitled "Powered Tree Construction," which is incorporated herein by reference as if set forth herein in its entirety.

FIELD OF THE INVENTION

Embodiments of the present disclosure relate generally to power transfer systems, and, more particularly, to power transfer systems for use with artificial trees, such as artificial Christmas trees.

BACKGROUND

As part of the celebration of the Christmas season, many people traditionally bring a pine or evergreen tree into their home and decorate it with ornaments, lights, garland, tinsel, and the like. Natural trees, however, can be quite expensive and are recognized by some as a waste of environmental resources. In addition, natural trees can be messy, leaving both sap and needles behind after removal, and requiring water to prevent drying out and becoming a fire hazard. Each time a natural tree is obtained it must be decorated, and at the end of the Christmas season the decorations must be removed. Because the needles have likely dried and may be quite sharp by this time, removal of the decorations can be a painful process. In addition, natural trees are often disposed in landfills, further polluting these overflowing environments.

To overcome the disadvantages of a natural Christmas tree, yet still incorporate a tree into the holiday celebration, a great variety of artificial Christmas trees are available. For the most part, these artificial trees must be assembled for use and disassembled after use. Artificial trees have the advantage of being usable over a period of years and thereby eliminate the annual expense of purchasing live trees for the short holiday season. Further, they help reduce the chopping down of trees for a temporary decoration, and the subsequent disposal, typically in a landfill, of same.

Generally, artificial Christmas trees comprise a multiplicity of branches each formed of a plurality of plastic needles held together by twisting a pair of wires about them. In other instances, the branches are formed by twisting a pair of wires about an elongated sheet of plastic material having a large multiplicity of transverse slits. In still other artificial Christmas trees, the branches are formed by injection molding of plastic.

Irrespective of the form of the branch, the most common form of artificial Christmas tree comprises a plurality of trunk sections connectable to one another. For example, in many designs, a first and second trunk section each comprise an elongate body. A first end of the body includes an extending portion (e.g., a male end) and a second end of the body includes a receiving portion (e.g., a female end). Typically, the body is a cylinder. Near the first end the body tapers slightly to reduce the diameter of the body. In other words, the diameter of the second end (i.e., the receiving portion), is larger than the diameter of the first end (i.e., the extending portion). To connect the trunk sections, the second end of a second trunk section receives the first end of a first trunk section. For example, the tapered end of the first trunk section is inserted into the non-tapered end of the second trunk section. In this manner, a plurality of trunk sections can be connected and a tree assembled.

One difficulty encountered during assembly, however, is the rotational alignment of the trunk sections. In some designs, the trunk sections comprise electrical systems. The electrical systems allow electricity to flow through the trunk of the tree and into accessories that can be plugged into outlets disposed on the trunk. To connect neighboring trunk sections, however, electrical prongs of one trunk section must be rotationally aligned with, and inserted into, electrical slots in another trunk section. This alignment process can be frustrating because it can be difficult for a user to judge whether the prongs will engage the slots when trunk sections are joined together. It may therefore take several attempts before a user can electrically connect two trunk sections.

What is needed, therefore, is a power transfer system for an artificial tree that allows a user to connect neighboring tree trunk sections without the need to rotationally align the trunk sections. Embodiments of the present disclosure address this need as well as other needs that will become apparent upon reading the description below in conjunction with the drawings.

BRIEF SUMMARY

Briefly described, embodiments of the present disclosure comprise a power transfer system to facilitate the transfer of electrical power between tree trunk sections of an artificial tree. The power transfer system can advantageously enable neighboring tree trunk sections to be electrically connected without the need to rotationally align the tree trunk sections during assembly. Embodiments of the present disclosure can therefore facilitate assembly of an artificial tree, reducing user frustration during the assembly process.

In some embodiments, the power transfer system can comprise a first power distribution subsystem disposed within or attached along a first trunk section of an artificial tree. The power transfer system can further comprise a second power distribution subsystem disposed within or attached along a second trunk section of an artificial tree. The first power distribution subsystem can comprise a male end with electrical prongs and the second power distribution subsystem can comprise a female end with electrical channels. The prongs can be inserted into the channels to conduct electricity between the power distribution subsystems, and, therefore, between the trunk sections of the tree.

To enable neighboring tree trunk sections to be electrically connected without the need to rotationally align the tree trunk sections, the male end can comprise an inner prong and an outer prong. Likewise, the female end can comprise an inner channel and an outer channel. The inner and outer channels may house inner and outer contact rings, respectively. When the trunk sections are joined, the inner and outer prongs may be positioned to contact the inner and outer contact rings, respectively, regardless of the rotational alignment of the tree trunk sections relative to one another about the vertical axis. Accordingly, the male end can electrically engage the female end in a variety of rotational configurations, and each configuration can provide a different rotational alignment between the first trunk section and the second trunk section.

Embodiments of the present disclosure can comprise an artificial tree comprising a plurality of tree trunk sections. The trunk sections can form a trunk of the artificial tree. A first power distribution subsystem can be disposed partially within a first trunk section of the plurality of tree trunk sections or the first power distribution system can be attached along the first tree trunk section. The first power distribution subsystem can comprise a male end having an inner prong and an outer prong. A second power distribution subsystem can be disposed partially within a second trunk section of the plurality of tree trunk sections, or the second power distribution system can be attached along the second tree trunk section. The second power distribution subsystem can comprise a female end having an inner channel and an outer channel. In some embodiments, the inner prong of the male end can be configured to engage the inner channel of the female end and the outer prong of the male end can be configured to engage the outer channel of the female end to form a coupling and conduct electricity between the first power distribution subsystem and the second power distribution subsystem. In this manner, the coupling may house at least a portion of the first and/or second power distribution subsystems externally from the tree trunk sections (e.g., such that the first and/or second power distribution subsystems are not entirely disposed within the tree trunk sections), which may provide easier access to or make it easier to replace wiring and other components of the first and second power distribution subsystems without distracting from the aesthetics of the artificial tree.

In some embodiments, the inner and outer channels of the female end can house substantially circular contact rings. The inner and outer channels may have a larger diameter than the tree trunk section, and may be aligned perpendicular to a height (in the vertical axis when the tree trunk is aligned upright) of the tree trunk. In this configuration, the inner channel may surround a lateral cross-section of the tree trunk, and the outer channel may surround the inner channel. Positioning the inner and outer channels around the tree trunk rather than inside of the tree trunk may provide easier access to or make it easier to replace the inner and outer contact rings and their related wiring and other components without distracting from the aesthetics of the artificial tree. Correspondingly, the inner and outer prongs of the male end of a neighboring tree trunk section may be positioned around the tree trunk rather than inside of the tree trunk to provide easier access to or make it easier to replace inner and outer prongs and their related wiring and other components without distracting from the aesthetics of the artificial tree.

In some embodiments, the inner and outer channels may be disposed proximate the same horizontal plane. Correspondingly, the inner and outer prongs may have the same height, such that they are configured to simultaneously contact the inner and outer channels when the male and female ends of the trunk sections mate. In other embodiments, the inner and outer channels may be disposed on different horizontal planes. The inner and outer prongs may have differing heights, such that they are configured to simultaneously contact the inner and outer channels when the male and female ends of the trunk sections mate. Further, one or more of the inner and outer prongs may be spring-loaded or otherwise vertically adjustable so that both the inner and outer prongs can maintain contact with the inner and outer channels regardless of the configuration of the inner and outer channels.

In some embodiments, an outlet can be disposed on one or more trunk sections, and the outlet can be configured to provide electrical power to a strand of lights. Additionally, some embodiments may include alignment mechanisms that can prevent the first trunk section from rotating with respect to the second trunk section after the tree trunk sections are assembled. Further, according to some embodiments, a power cord can be configured to engage a wall outlet and provide power to the first power distribution subsystem and the second power distribution subsystem.

Embodiments of the present disclosure can further comprise a system for connecting tree trunk sections of an artificial tree. The system can comprise a first power distribution subsystem having a male end, and the male end can have one or more electrical prongs. The system can further comprise a second power distribution subsystem having a female end, and the female end can have one or more electrical channels. In some embodiments, the one or more electrical prongs of the first power distribution subsystem can engage one or more electrical channels of the second power distribution subsystem to conduct electricity between the first power distribution subsystem and the second power distribution subsystem. In some embodiments, the one or more electrical prongs of the first power distribution subsystem can engage one or more electrical channels of the second power distribution subsystem in a plurality of configurations, and each configuration can provide a different rotational alignment between the first power distribution subsystem and the second power distribution subsystem.

Embodiments of the present disclosure can further comprise a connector system for electrically connecting a plurality of power distribution subsystems of a plurality of tree trunk sections that form an artificial tree. The connector system can comprise a male component disposed on an end of a first tree trunk section of the plurality of tree trunk sections, and the male component can have an inner prong and an outer prong. The connector system can further comprise a female component disposed on an opposite end of the first tree trunk section. The female component can have an inner channel and an outer channel, each housing a substantially circular contact ring. The outer channel may have a larger diameter than the inner channel, and the inner and outer channels may each have a larger diameter than the tree trunk section.

The foregoing summarizes only a few aspects of the present disclosure and is not intended to be reflective of the full scope of the present disclosure. Additional features and advantages of the present disclosure are set forth in the following detailed description and drawings, may be apparent from the detailed description and drawings, or may be learned by practicing the present disclosure. Moreover, both the foregoing summary and following detailed description are exemplary and explanatory and are intended to provide further explanation of the presently disclosed invention as claimed

BRIEF DESCRIPTION OF THE DRAWINGS

The accompanying drawings, which are incorporated in and constitute a part of this specification, illustrate multiple embodiments of the presently disclosed subject matter and serve to explain the principles of the presently disclosed subject matter. The drawings are not intended to limit the scope of the presently disclosed subject matter in any manner.

DETAILED DESCRIPTION

Figure 1:
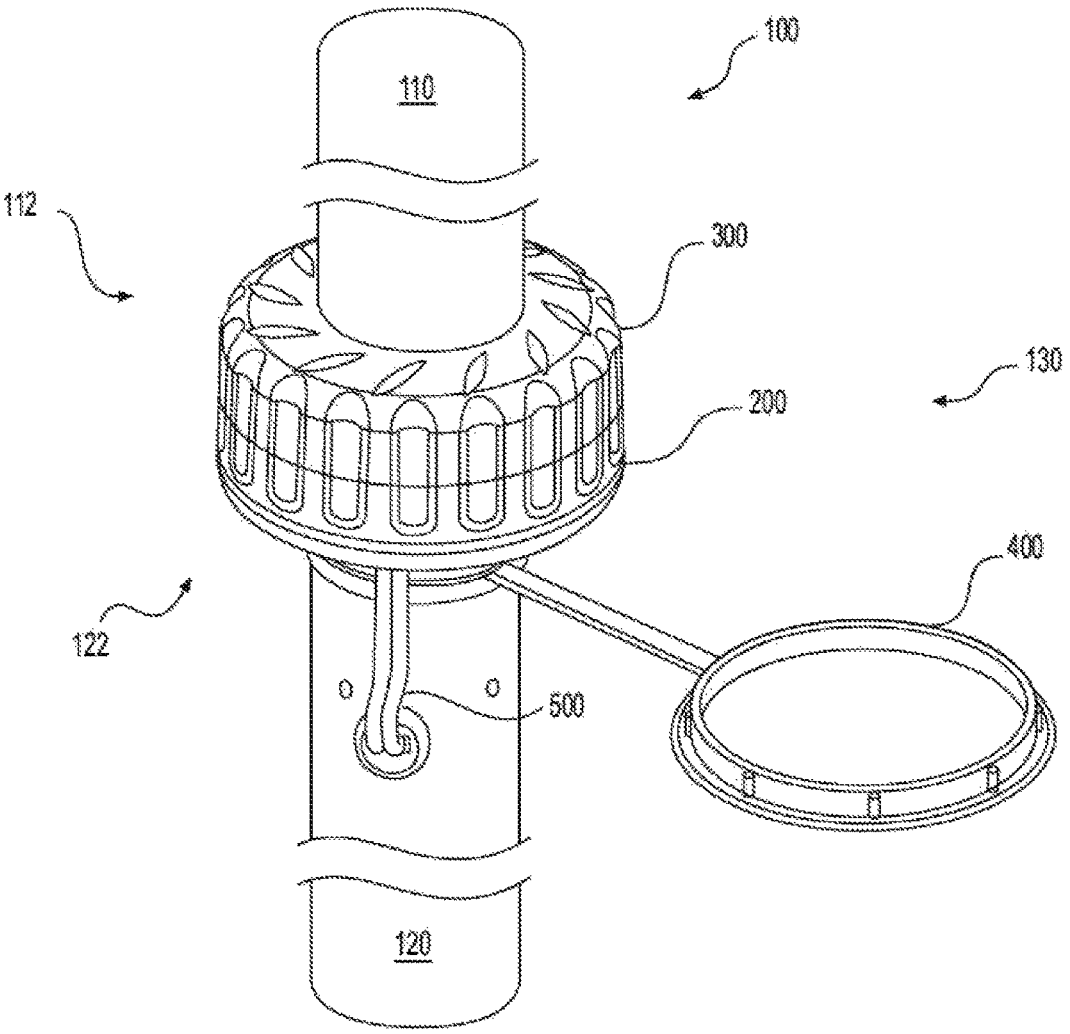
FIG. 1 depicts a perspective view of assembled tree trunk sections having power distribution subsystems, in accordance with some embodiments of the present disclosure.

Embodiments of the present disclosure relate to artificial Christmas trees. Although preferred embodiments of the invention are explained in detail, it is to be understood that other embodiments are contemplated. Accordingly, it is not intended that the invention is limited in its scope to the details of construction and arrangement of components set forth in the following description or illustrated in the drawings. The invention is capable of other embodiments and of being practiced or carried out in various ways. Also, in describing the preferred embodiments, specific terminology will be resorted to for the sake of clarity.

It should also be noted that, as used in the specification and the appended claims, the singular forms "a," "an" and "the" include plural references unless the context clearly dictates otherwise. References to a composition containing "a" constituent is intended to include other constituents in addition to the one named.

Also, in describing the preferred embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

It is also to be understood that the mention of one or more method steps does not preclude the presence of additional method steps or intervening method steps between those steps expressly identified. Moreover, although the term "step" may be used herein to connote different aspects of methods employed, the term should not be interpreted as implying any particular order among or between various steps herein disclosed unless and except when the order of individual steps is explicitly required.

The components described hereinafter as making up various elements of the invention are intended to be illustrative and not restrictive. Many suitable components that would perform the same or similar functions as the components described herein are intended to be embraced within the scope of the invention. Such other components not described herein can include, but are not limited to, for example, similar components that are developed after development of the presently disclosed subject matter.

To facilitate an understanding of the principles and features of the invention, various illustrative embodiments are explained below. In particular, the presently disclosed subject matter is described in the context of being an artificial tree power system. The present disclosure, however, is not so limited, and can be applicable in other contexts. For example and not limitation, some embodiments of the present disclosure may improve other power systems, such as light poles, lamps, extension cord systems, power cord connection systems, and the like. These embodiments are contemplated within the scope of the present disclosure. Accordingly, when the present disclosure is described in the context of a power transfer system for an artificial Christmas tree, it will be understood that other embodiments can take the place of those referred to.

When assembling an artificial tree, decorators commonly desire to illuminate the tree with one or more light strings, i.e., strands of lights. The light strings require electrical power and are conventionally connected in series. In many designs, at least one of the light strings is connected to a wall outlet to provide power to all of the light strings. When decorating a tree, the decorator can walk around the tree, placing the light strings on various locations on the branches of the tree. In order to provide power to all of the light strings, typical light strings come with a first end in the form of a male end and a second end in the form of a female end.

To provide power to more than one light string, the decorator can insert the male end of one light string into the female end of another light string. In doing so, the light string that is electrically connected to a wall outlet (or other power source) transfers electrical energy from the source to subsequent light strings. In some conventional systems, the lights strings can have multiple points of electrical connectivity, providing for parallel or serial connectivity. Even so, the flow of power is usually from one light string connected to the power source to one or more downstream light strings.

The act of providing power from the power source to one or more light strings can be cumbersome and frustrating for a decorator. In order to attach multiple light strings together, the decorator will either need to attach the light strings prior to their placement on the tree or attach the light strings after they have been placed on the tree. If the decorator attaches multiple light strings together, in order to "wrap" the tree with the light strings, the decorator often must walk around the tree, carrying the multiple strings. If the decorator waits until after the light strings are placed on the tree, the decorator will need to reach through the tree branches and electrically connect the light strings. The decorator would also likely need to manipulate the light strings in order to connect the strings together. This process can be difficult and can take an extended amount of time.

To alleviate issues associated with providing power to light strings in conventional artificial trees, and to provide further advantages, the present disclosure comprises a power transfer system for an artificial tree. In an exemplary embodiment, an artificial tree trunk comprises tree trunk sections that are engaged with one another to form the trunk of an artificial tree. At least some of the tree trunk sections may be hollow, and power distribution subsystems may be partially disposed within one or more tree trunk sections. In some embodiments, power distribution subsystems can comprise a female end, a male end, or both located proximate the ends of the tree trunk sections. In some embodiments, when one tree trunk section is engaged with another tree trunk section, the male end of one power distribution subsystem engages with and is electrically connected to the female end of a neighboring power distribution subsystem. The engaged male and female ends may be joined via a coupling, and the coupling may house at least a portion of the power distribution subsystems externally to the tree trunk sections, which may provide easier access to or make it easier to replace wiring and other components of the power distribution subsystems without distracting from the aesthetics of the artificial tree. One or more of the power subsystems may be in electrical communication with an external power source (e.g., a wall outlet), and configured to provide electricity to joined power distribution subsystems. Thus, by electrically connecting a power distribution subsystem of a tree trunk section to an external power source, electrical power flows from the source to that tree trunk section, and from that tree trunk section through the coupling and on to other tree trunk sections.

A variety of systems exist to facilitate joining the male and female ends of power distribution subsystems. Although conventional plug and outlet systems can be used, such as those manufactured in accordance with NEMA standards, in some cases, it can be difficult in conventional designs to align the male prongs of one tree trunk section with the female holes of another tree trunk section. In order to engage the male end with the female end, the assembler of the tree often must vertically align the tree trunk sections and additionally rotationally align the two tree trunk sections to allow the male prongs to line up with the female holes. Even if the tree trunk sections are perfectly vertical, in conventional systems, the male prongs can only engage the female holes if the male prongs are rotationally aligned with the female holes. If the male prongs are not rotationally aligned with the female holes, the male prongs may abut the area around the female holes rather than being inserted into the female holes, and an electrical connection will not be made. Attempting to align the male prongs and the female holes can therefore take significant time, and can be a frustrating experience for a user.

To alleviate this problem, in one embodiment, the present disclosure comprises a female end having an inner channel for receiving an inner male prong of the male end and an outer channel disposed around the inner channel for receiving an outer male prong. In this configuration, the assembler of the tree trunk sections can be less concerned with the rotational alignment of the two tree trunk sections, as the channel provides for engagement with the male end at various rotational alignments. In exemplary embodiments, the inner and outer channels may be substantially circular so that, regardless of the rotational alignment between the tree trunk sections, the male prongs can engage the female channels. This can make the assembly process much easier and more enjoyable for a user.

Embodiments of the present disclosure can also be used in a variety of systems. For example, some embodiments can be used in low voltage systems (e.g., 5V systems for powering LEDs or small electronics), and other embodiments can be used in high voltage systems (e.g., 120V or 240V systems that may originate from a wall outlet).

Embodiments of the present disclosure can be used with a variety of devices or systems, including a power distribution system (or subsystem) of an artificial tree. In some embodiments, an artificial tree may include 3-6 tree trunk sections (or more, depending on the desired tree height and the height of each tree trunk section). These tree trunk sections may be vertically stacked or otherwise attached on top of one another to form the tree trunk. A plurality of branches may be attachable to the tree trunk (or already attached, and foldable) to follow the appearance and structure of a natural tree. In some embodiments, the artificial tree may be pre-lit, such that a power cord extending from the tree can be plugged into a wall outlet to power a string of lights that is pre-arranged around the branches of the artificial tree. Pre-lit artificial trees may be advantageous over other artificial trees because they expedite and simplify assembly and disassembly of the tree. Embodiments of the present disclosure further expedite and simplify assembly and disassembly of the pre-lit artificial tree by not requiring rotational alignment of the tree trunk sections relative to one another.

Referring now to the figures, wherein like reference numerals represent like parts throughout the views, exemplary embodiments will be described in detail.

FIG. 1 depicts an exemplary embodiment of a portion of an assembled tree trunk 100. Tree trunk 100 may include a plurality of tree trunk sections (e.g., a first tree trunk section 110 and a second tree trunk section 120). As shown, a male end 112 of the first tree trunk section 110 may be attachable to a female end 122 of the second tree trunk section 120 via a coupling 130. In some embodiments, the coupling 130 may be formed by a female component 200, which is attachable to the female end 122 of the second tree trunk section 120, and a male component 300, which is attachable to the male end 112 of the first tree trunk section 110. The female component 200 may be configured receive the male component 300 to facilitate electrical communication between power distribution subsystems of the first and second tree trunk sections 110, 120.

Shown in further detail in FIGS. 2A-F, the female component 200 may include a channel housing 210, an outer contact ring 220, an inner contact ring 230, and a lower cover 240. The outer and inner contacts rings 220, 230 may reside within inner and outer channels formed on an upper surface of the channel housing 210. The lower cover 240 may be attachable to the bottom surface of the channel housing 210 to contain and shield electronic components disposed within the female component 200 from the external environment.

The channel housing 210 may include an inner wall 212, a middle wall 214, and an outer wall 216 that collectively form inner and outer channels for housing the outer and inner contact rings 220, 230, respectively. One of the outer and inner contact rings 220, 230 may provide a "positive" or "hot" flow path for electricity while the other contact ring provides a "negative" or "return" flow path for electricity. The walls 212, 214, 216 may be sized and shaped to accommodate the outer and inner contact rings 220, 230. For example, in some embodiments, the walls 212, 214, and 216 may be substantially circular. The inner wall 212 may have a larger diameter than the second tree trunk section 120, and the middle wall 214 and the outer wall 216 may have progressively larger diameters. In this manner, each subsequent outer wall may surround a neighboring inner wall. In some embodiments, the walls 212, 214, and 216 may have the same height and thickness. In other embodiments, the walls 212, 214, and 216 may have differing heights and/or thicknesses to match the size of mating features of the male component 300. In other embodiments, the tops of the walls 212, 214, 216 may be tapered. In some embodiments, the channel housing 210 may also include a bottom lip 218. The bottom lip 218 may outwardly extend from the outer wall 216 of the channel housing 210, and provide a contact surface that defines a stop point when the female component 200 mates with the male component 300. It is contemplated that the channel housing 210 may be formed as a single part or be composed of several attachable parts. The channel housing 210 may be constructed of a sufficiently rigid material, such as a suitable plastic, to maintain the shape of the outer and inner contact rings 220, 230 and to support connected tree trunk sections.

Figure 2A:
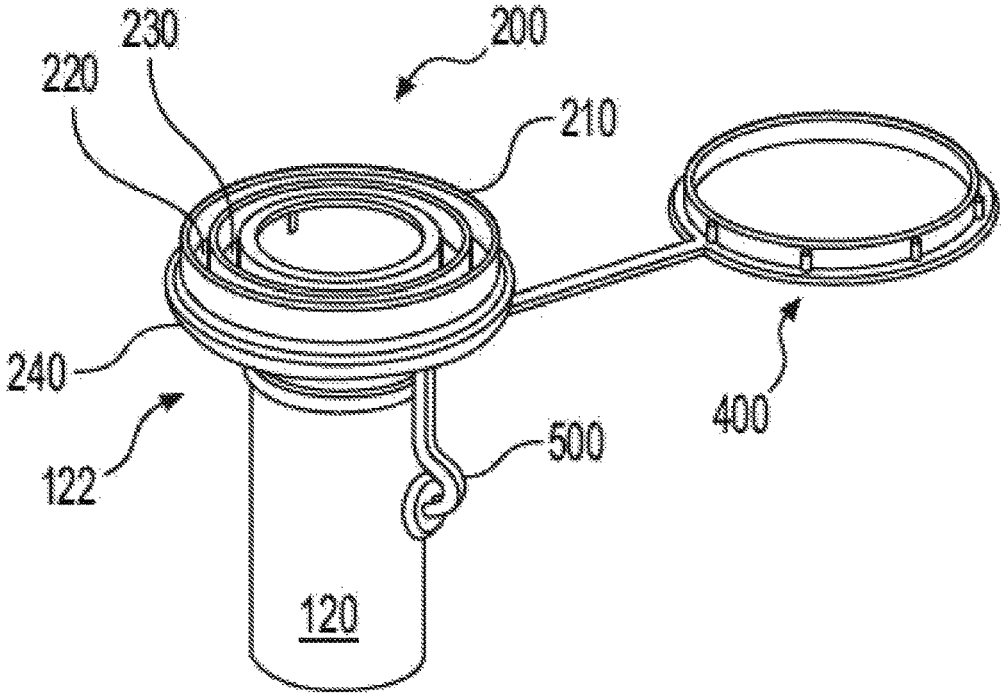
FIG. 2A depicts a perspective view of a female end of a tree trunk section, in accordance with some embodiments of the present disclosure.
Figure 2B:
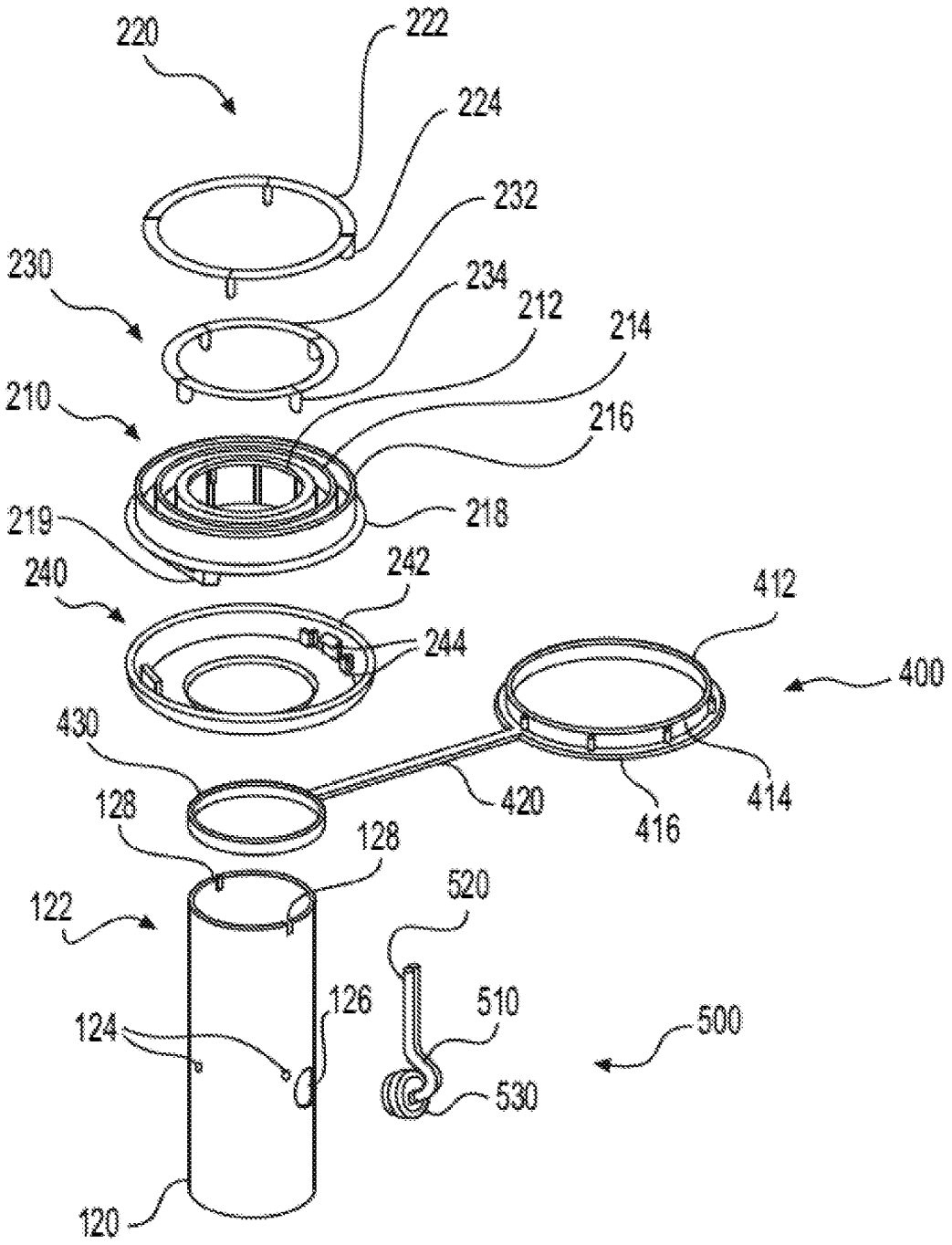
FIG. 2B depicts an exploded view of a female end of a tree trunk section, in accordance with some embodiments of the present disclosure.
Figure 2C:
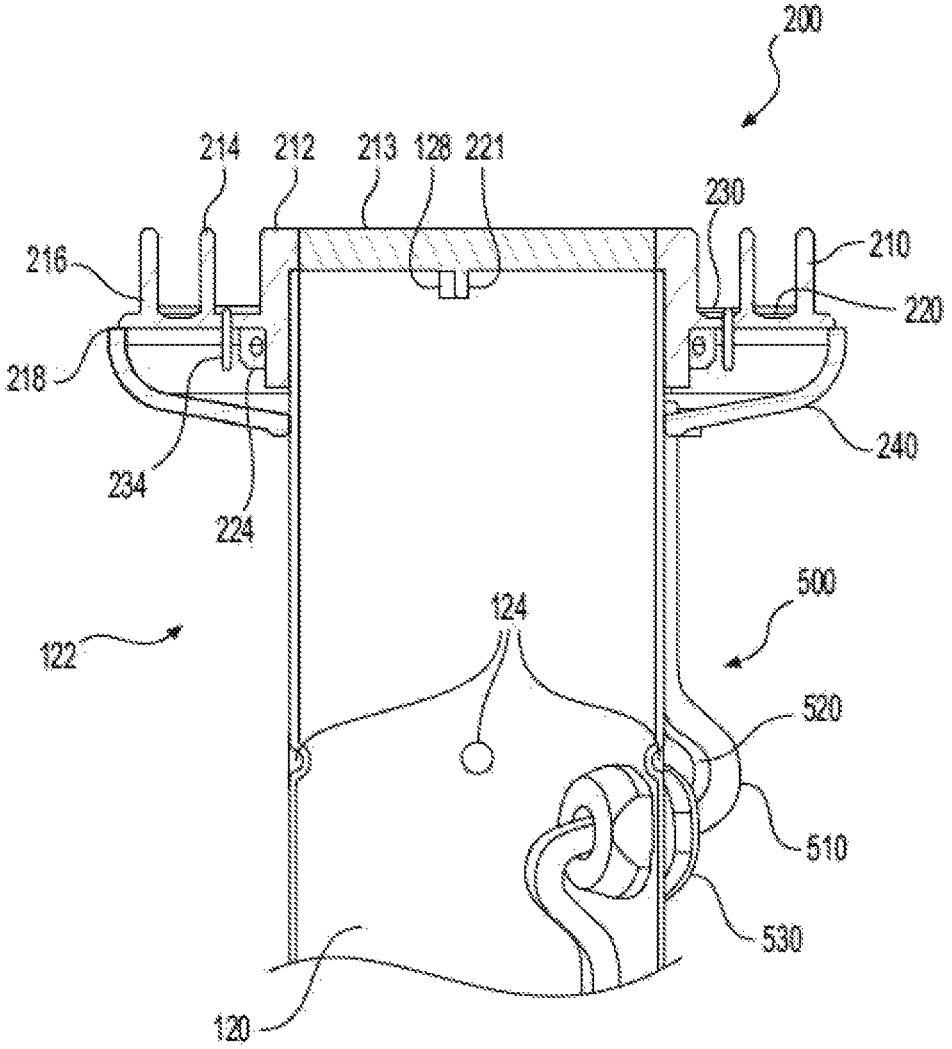
FIG. 2C depicts a cross-sectional side view of a female end of a tree trunk section, in accordance with some embodiments of the present disclosure.
Figure 2D:
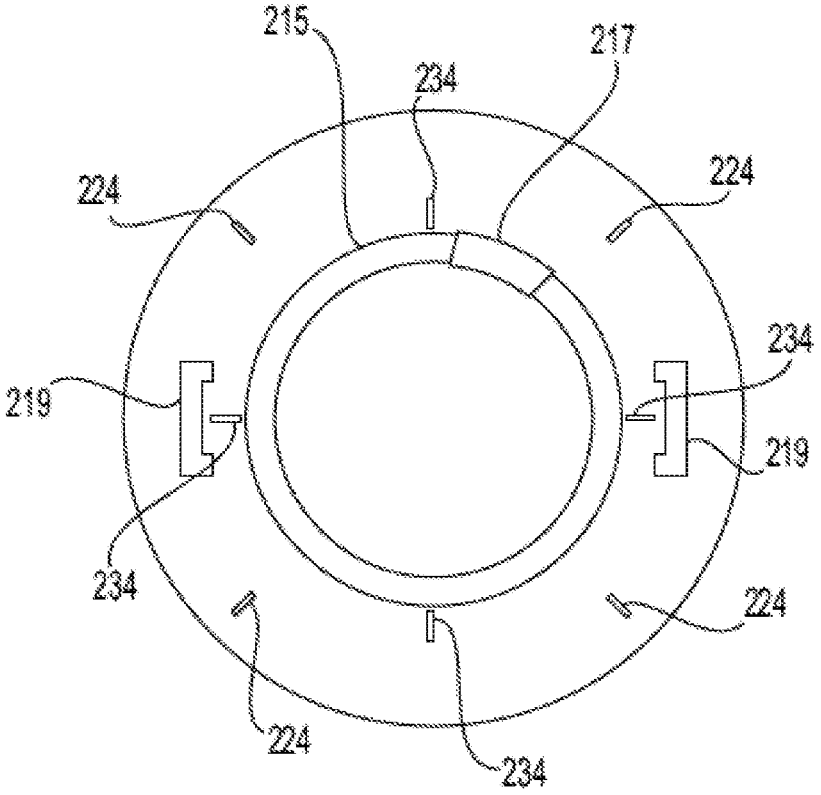
FIG. 2D depicts a bottom view of a channel housing on a female end of a tree trunk section, in accordance with some embodiments of the present disclosure.
Figure 2E:
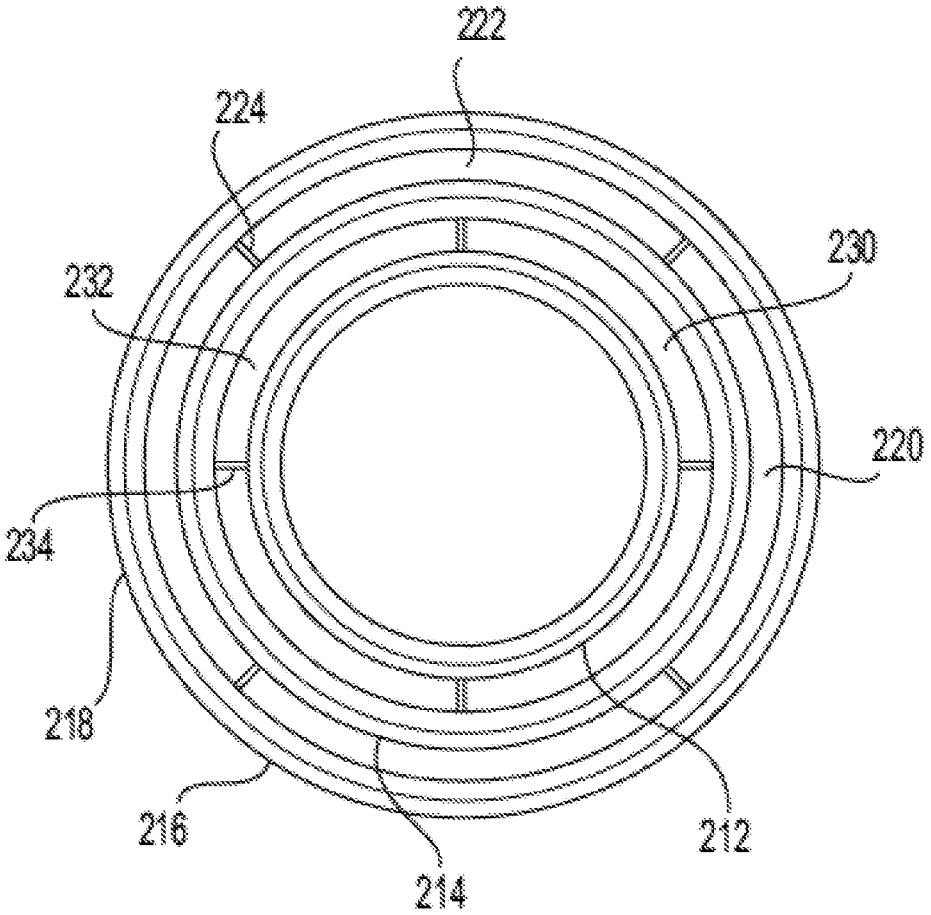
FIG. 2E depicts a top view of a channel housing on a female end of a tree trunk section, in accordance with some embodiments of the present disclosure.
Figure 2F:
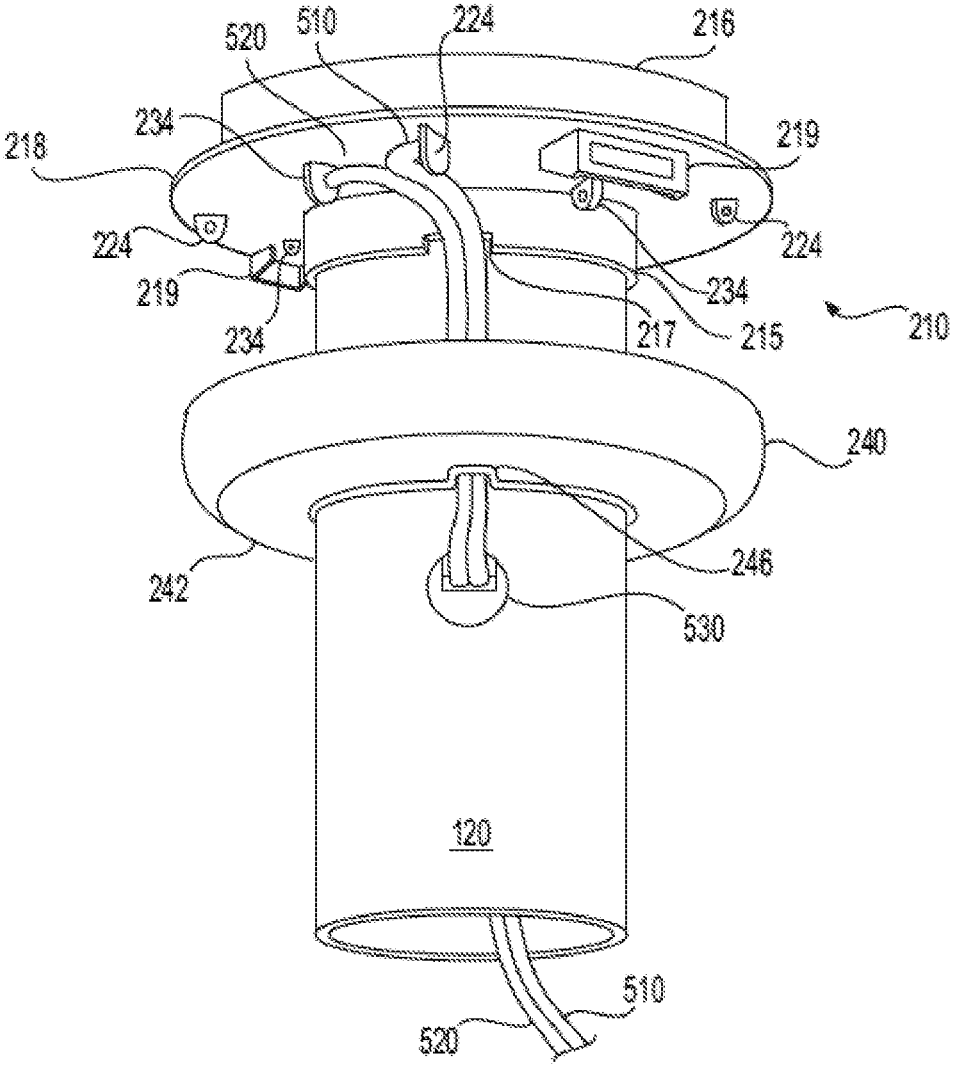
FIG. 2F depicts a perspective bottom view of a disassembled female end of a tree trunk section, in accordance with some embodiments of the present disclosure.

Opposite the defined channels, the bottom surface of the channel housing may include a support wall 215 having one or more notches 217, and one or more lower fasteners 219. The support wall 215 may extend along and snugly fit around a portion of the second tree trunk section 210 in the vertical axis. In this manner, the support wall 215 may stabilize the position and orientation of the channel housing 210 on the female end 122 of the second tree trunk section 120. As shown in FIGS. 2D and 2F, the notches 217 may form a small cutout of the support wall 215 that can receive and direct wiring within the female component 200. In some embodiments, each notch 217 may be rectangular and size to receive two or more wires. In other embodiments, multiple notches 217 may be sized and positioned to receive a single wire. Positioned between the support wall 215 and the bottom lip 218, the one or more fasteners 219 may protrude from the bottom surface of the channel housing 210, as shown in FIGS. 2D and 2E, and allow an assembler to selectively attach the lower cover 240 to the channel housing 210. In some embodiments, the fasteners 219 may be formed with the channel housing 210 as an integral part. In other embodiments, the fasteners 219 may include separate components that are attachable to the bottom surface of the channel housing 210. The fasteners 219 may take on a variety of shapes as appropriate to facilitate the mating of the lower cover 240 and the bottom surface of the channel housing 210. For example, in some embodiments, the fasteners 219 may form a female component, as shown in FIG. 2F, that can selectively receive a male component. In other embodiments, the fasteners 219 may form a male component configured to selectively mate with a female component.

Insertable within the channel housing 210, the outer contact ring 220 may include a substantially circular flat surface 222, which may be continuous or separated into segments, and one or more tabs 224 extending away from the flat surface 222. In some embodiments, the tabs 224 may downwardly extend from the flat surface 222 through one or more apertures in the bottom surface of the channel housing 210. The tabs 224 may include one or more apertures, as shown in FIGS. 2C and 2F, for receiving wires associated with a power distribution subsystem. The tabs 224 may be located at any position along the outer contact ring 220. In some embodiments, four tabs 224 may downwardly extend from the flat surface 222 and protrude beyond the bottom surface of the channel housing 210 as shown in FIG. 2D. The four tabs 224 may be evenly spaced apart (e.g., about 90° apart) and each downwardly extend proximate the same horizontal plane. The tabs 224 may be configured to face a different direction than the neighboring tabs 224. For example, as shown in FIG. 2D, each sequential tab 224 may rotate 90° from the previous tab 224 so that it extends radially. In some embodiments, the outer contact ring 220 may include conductive material configured to conduct electricity from at least a portion of the flat surface 222 to one or more of the tabs 224.

The inner contact ring 230 may include a substantially circular flat surface 232, which may be continuous or separated into segments, and one or more tabs 234 extending away from the flat surface 232. In some embodiments, the tabs 234 may downwardly extend from the flat surface 232 through one or more apertures in the bottom surface of the channel housing 210. The tabs 234 may include one or more apertures, as shown in FIGS. 2C and 2F, for receiving wires associated with a power distribution subsystem. The tabs 234 may be located at any position along the inner contact ring 230. In some embodiments, four tabs 234 may downwardly extend from the flat surface 232 and protrude beyond the bottom surface of the channel housing 210 as shown in FIG. 2D. The four tabs 234 may be evenly spaced apart (e.g., about 90° apart) and each downwardly extend proximate the same horizontal plane. The tabs 234 may be configured to face a different direction than the neighboring tabs 234. For example, as shown in FIG. 2D, each sequential tab 234 may rotate 90° from the previous tab 234 so that it extends radially. In some embodiments, the inner contact ring 230 may include conductive material configured to conduct electricity from at least a portion of the flat surface 232 to one or more of the tabs 234.

Figure 5:
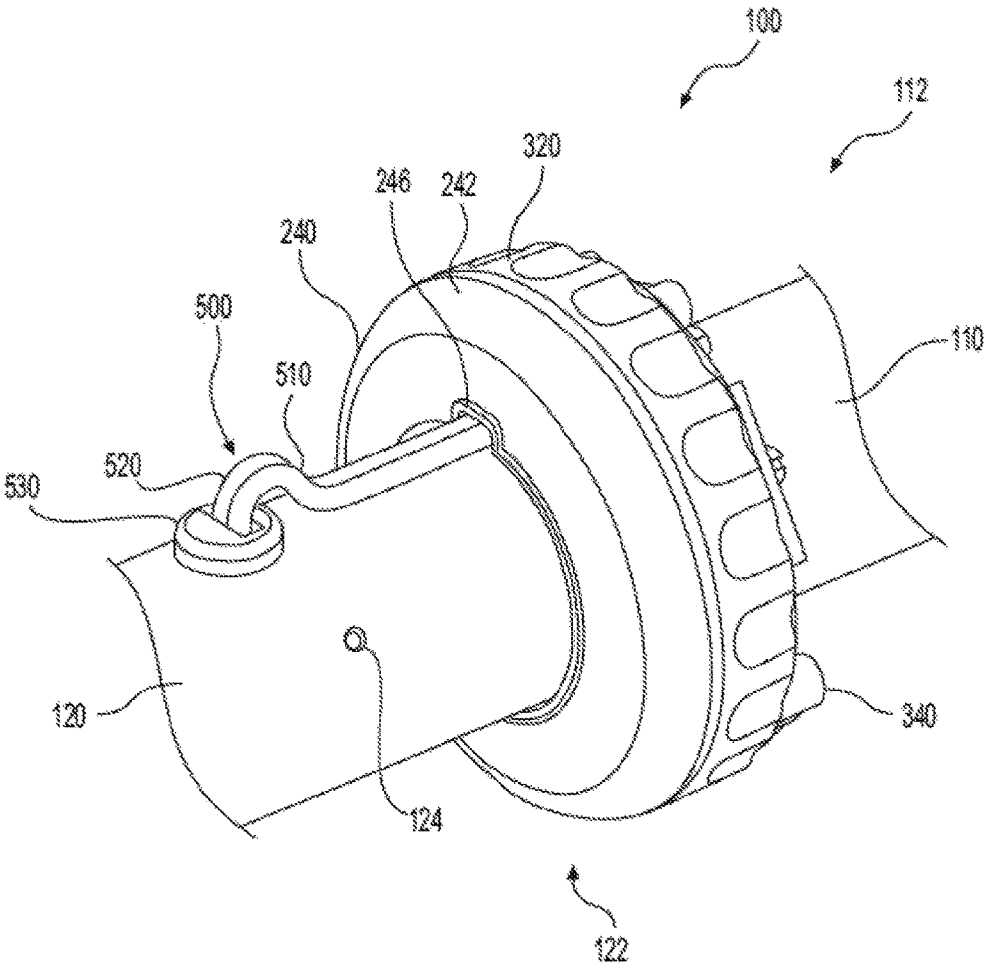
FIG. 5 depicts a perspective bottom side view of partially assembled tree trunk sections having power distribution subsystems, in accordance with some embodiments of the present disclosure.

Opposite the outer and inner contact rings 220, 230, the lower cover 240 may be attachable to the bottom surface of the channel housing 210. In the some embodiments, the lower cover 240 may include an outer wall 242 configured to abut the bottom surface of the channel housing and one or more fasteners 244 configured to mate with or otherwise attach to one or more of the lower fasteners 219 on the channel housing 210. The lower cover 240 may also include one or more notches 246, as shown in FIGS. 2F and 5, to allow wiring associated with the female component 200 to exit the lower cover 240. The one or more notches 246 may form a small cutout of the outer wall 242 that can receive and direct wiring out of the female component 200.

Along with the female component 200, the female end 122 of the second tree trunk section 120 may also house an attachable safety cover 400 and wiring 500. As shown in FIG. 2B, safety cover 400 may be configured to cover the otherwise exposed contact rings 220, 230 disposed within the channel housing 210 when the female component 200 is not engaged with the male component 300. The safety cover 400 can therefore prevent a person from inadvertently touching the contact rings 220, 230, which could lead to electric shock. The safety cover 400 can also prevent various items from entering the channels of the channel housing 210 and causing damage to or blocking access to the contact rings 220, 230. In some embodiments, the safety cover may include a substantially circular top ridge 412, an outer wall 414, a substantially circular bottom ridge 416, a connecting arm 420, and an attachment member 430. The top ridge 412 may be configured for insertion within one or more of the inner and outer channels defined by the channel housing 210, while the bottom ridge 416 may be configured to cover both the inner and outer channels of the channel housing 210. The outer wall 414 may include one or more ridges configured to abut the sidewalls of the inner and outer channels and help maintain the position of the safety cover over the channels. The connecting arm 420 may be flexible and configured to allow the bottom ridge 416 to cover the inner and outer channels of the channel housing 210 while the attachment member 430 remains attached to the second tree trunk section 120. In some embodiments, the connecting arm 420 may have a fixed length. In other embodiments, the connecting arm 420 may have an adjustable length. The attachment member 430 may have a fixed or adjustable diameter, and be configured to snugly fit around the outer diameter of the second tree trunk section 120.

The wiring 500 may include two or more electrical wires. For example, as shown in FIGS. 2B and 2C, the wiring 500 may include a first wire 510 and a second wire 520, which each extend away from the lower cover 240 and into the second tree trunk section 120 via a cushion 530, as shown in FIG. 5. The first and second wires 510, 520 may connect to the tabs 224, 234 extending down from the channel housing 210, as shown in FIG. 2F (with the lower cover 240 partially removed). For example, in one embodiment the first wire 510 may connect to the tab 224 of the outer contact ring 220 (e.g., to carry a positive charge), and the second wire 520 may connect to the tab 234 of the inner contact ring 230 (e.g., to carry a negative charge). In some embodiments, the first and second wires 510, 520 may pass through an aperture in one or more of the tabs 224, 234 to connect the wires 510, 520 to the outer and inner contact rings 220, 230. To strengthen the connection, the wires 510, 520 may be wrapped through the apertures and around a portion of the tabs 224, 234 or soldered to the tabs 224, 234.

Figure 7A:
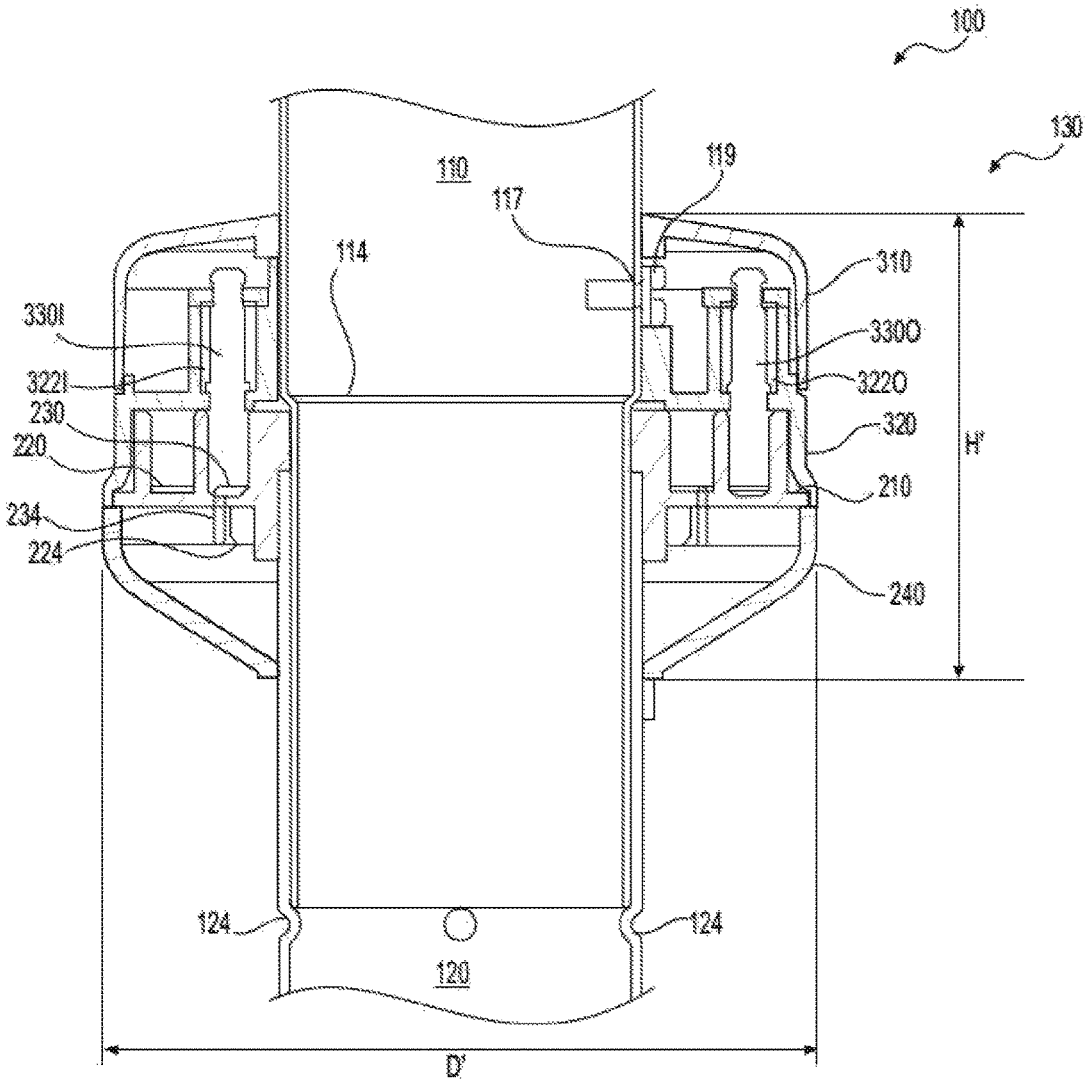
FIG. 7A depicts a cross-sectional side view of a female end of a tree trunk section being joined with a male end of a tree trunk section having one stabilizer screw, in accordance with some embodiments of the present disclosure.
Figure 7B:
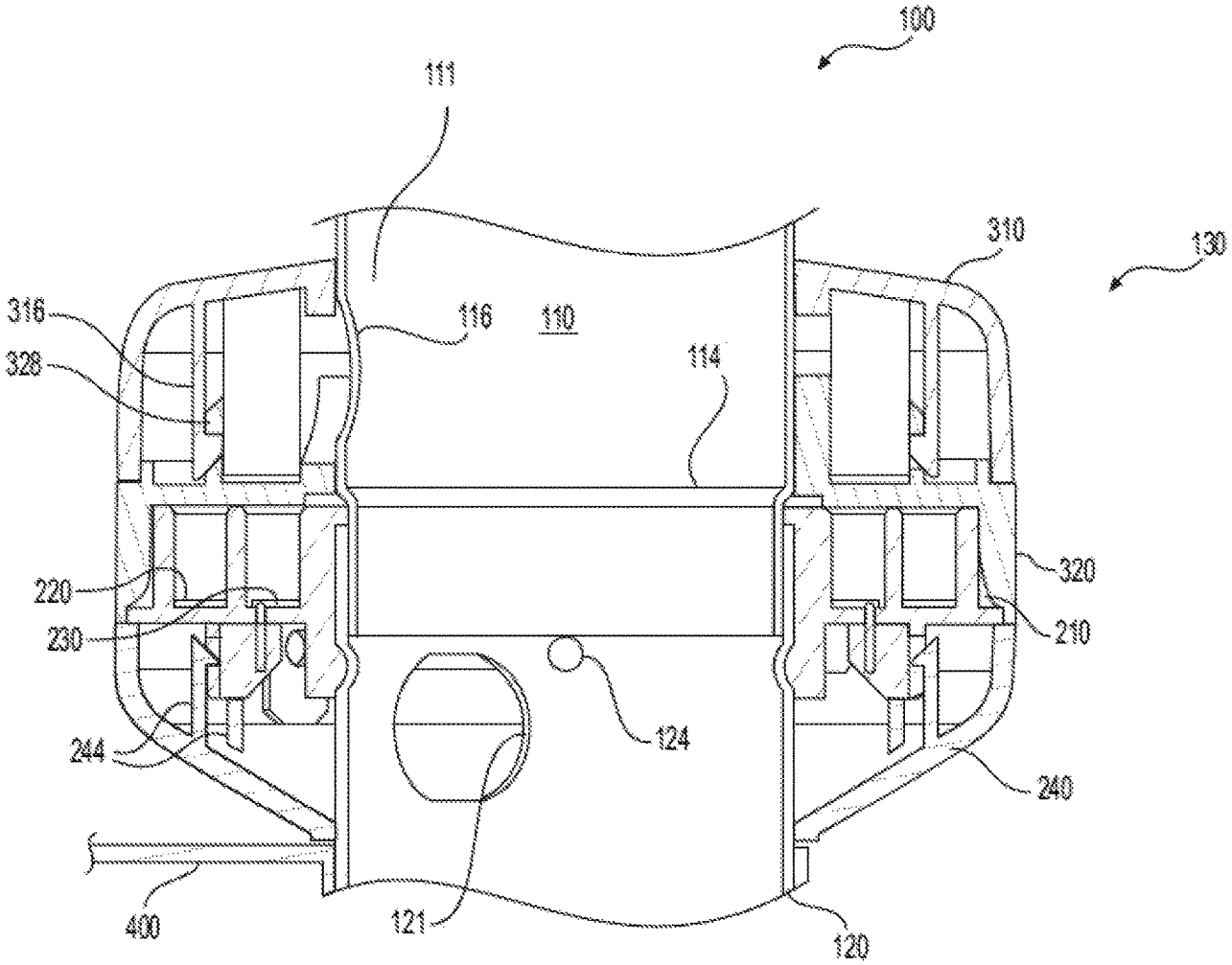
FIG. 7B depicts a cross-sectional side view of a female end of a tree trunk section being joined with a male end of a tree trunk section having upper and lower wiring holes, in accordance with some embodiments of the present disclosure.

In practice, electrical current may flow from an external power source (e.g., a wall outlet or battery) into a wire extending from a tree trunk section at the base of the tree (e.g., into wiring 500 disposed within and extending from the second tree trunk section 120). The wires 510, 520 may extend out of the second tree trunk section 120 below the coupling 130, as shown in FIG. 2C, and enter the female component 200 and connect to one or more of the tabs 224, 234 of the outer and inner contact rings 220, 230. In this manner, electrical current may flow through the wires 510, 520 as they extend out of the second tree trunk section 120 and through the outer and inner contact rings 220, 230. In other embodiments, the wires 510, 520 may exit the second tree trunk section 120 directly into the female component 200, as shown in FIGS. 7A and 7B. Regardless of the path of the wires 510, 520 before they connect to the outer and inner contact rings 220, 230, when the female and male components 200, 300 of the coupling 130 are engaged, the outer and inner contact rings 220, 230 may be configured to pass the electrical current to the power distribution subsystem of the first tree trunk section 110. The wiring 500 may also be in electrical communication with one or more electrical power outlets 150 positioned along the second tree trunk section 120, such that the wiring 500 could provide power to a string of lights plugged into an electrical power outlet 150 on the second tree trunk section 120.

In some embodiments, the female end 122 of the second tree trunk section 120 may include several features to better control mating with the first end 112 of the first tree trunk section 110. For example, as shown in FIGS. 2B and 2C, proximate a top surface of the female end 122, the second tree trunk section 120 may include one or more notches 128. The notches 128 may be configured to slidably receive one or more protrusions 221 extending inwardly from an inner surface of the channel housing 210 to maintain a position and/or a rotational alignment of the channel housing 210 relative to the second tree trunk section 120. In some embodiments, the female end 122 may include two notches 128 configured to slidably receive a pair of protrusions 221. Each notch 128 and protrusion 221 may be evenly spaced apart from one another along a diameter of the second tree trunk section 120 and channel housing 210, respectively.

Away from the upper surface of the female end 122, the second tree trunk section 120 may include one or more inwardly extending dimples 124 (see, e.g., FIGS. 2B and 2C) configured to prevent the male end 112 of the first tree trunk section 110 from downwardly passing beyond the dimples 124. The dimples 124 may be equally spaced along a horizontal cross-section of the second tree trunk section 120 (e.g., four dimples 124 spaced about 90° apart from one another). In some embodiments, the dimples 124 may inwardly extend at least the wall thickness of the male end 112 of the first tree trunk section 110. As will be appreciated, such features may provide increased control in mating the female end 122 of the second tree trunk section 120 to the male end 112 of the first tree trunk section 110.

The second tree trunk section 120 may also include one or more apertures 126 configured to allow the wiring 500 to pass through the side of the second tree trunk section 120. In some embodiments, as shown in FIG. 2B, the aperture 126 may be configured to receive the cushion 530 with the first and second wires 510, 520.

Configured to mate with the female component 200, the male component 300 may be positioned proximate the male end 112 of the first tree trunk section 110. Shown in further detail in FIGS. 3A-E, the male component 300 may include an upper cover 310, a prong housing 320, two or more prongs (e.g., an inner prong 330I and an outer prong 330O), one or more prong connectors 340, one or more electrical connectors 350, and one or more screws 360. The inner and outer prongs 330I, 330O may partially reside within the prong housing 320, and downwardly extend from the prong housing 320 to selectively engage the inner and outer channels, respectively, of the female component 200. The upper cover 310 may be attachable to the top surface of the prong housing 320 to contain and shield electronic components disposed within the male component 300 from the external environment.

The upper cover 310 may include an outer wall 312 having a plurality of grooves 314 to provide an enhanced grip for an assembler. The grooves 314 may form a repeating geometric pattern along an entire side surface of the outer wall 312. On its underside, the upper cover 310 may include one or more fasteners 316, as shown in FIG. 3D, that are configured to selectively attach the upper cover to the prong housing 320. In some embodiments, a pair of fasteners 316 may be positioned on opposing sides on the underside of the upper cover 310.

The prong housing 320 may include two or more prong cavities (e.g., inner and outer prong cavities 322I, 322O) with connectors 324 for holding the prongs 330O, 330I in place, an outer wall 326, one or more fasteners 328 for connecting the prong housing 320 to the upper cover 310, a support wall 327 that upwardly extends from the prong housing 320 proximate the first tree trunk section 110, and one or more notches 329 in the support wall 327.

The inner prong cavity 322I may be configured to line up with the inner contact ring 230 of the female component 200, and the outer prong cavity 322O may be configured to line up with the outer contact ring 220 of the female component. In some embodiments, the prong cavities 322I, 322O may be equally spread out along the prong housing 320 (e.g., about 180° apart). In some embodiments, the outer wall 326 of the prong housing 320 may include a plurality of grooves or other grippable shapes, which may align with and extend from the grooves 314 of the upper cover 310 when the upper cover 310 and prong housing 320 are connected, to facilitate easier rotation of the prong housing 320 relative to other components of the coupling 130.

Figure 3A:
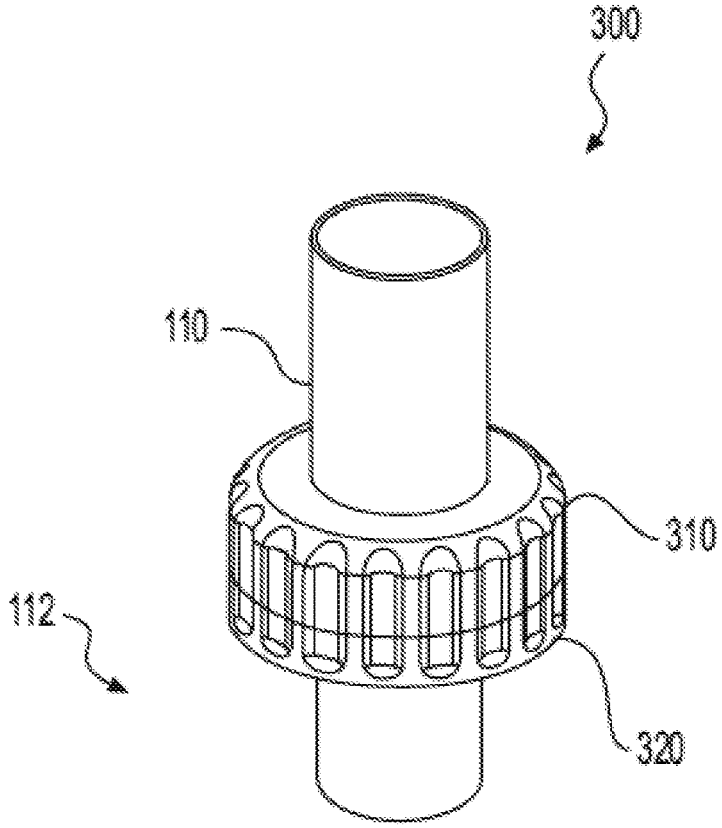
FIG. 3A depicts a perspective view of a male end of a tree trunk section, in accordance with some embodiments of the present disclosure.
Figure 3B:
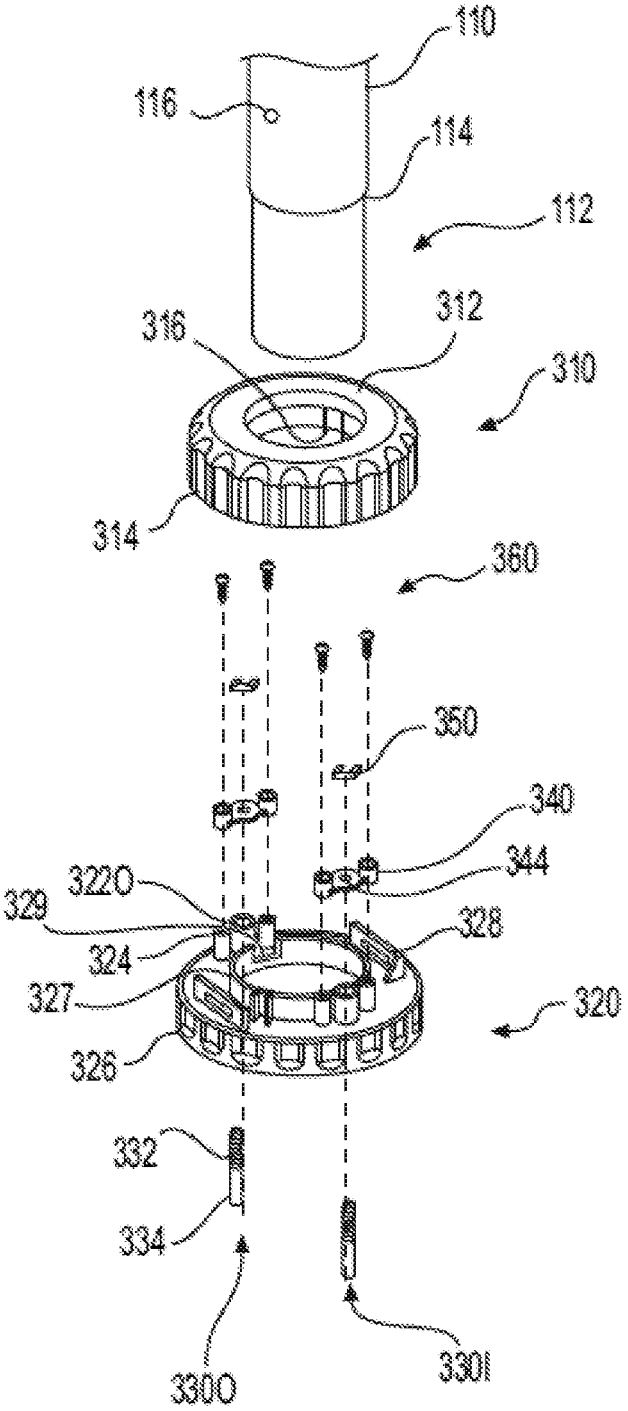
FIG. 3B depicts an exploded view of a male end of a tree trunk section, in accordance with some embodiments of the present disclosure.

Positioned between the support wall 327 and the outer wall 326, the one or more fasteners 328 may protrude from the upper surface of the prong housing 320, as shown in FIG. 3B, and allow an assembler to selectively attach the upper cover 310 to the prong housing 320. In some embodiments, the fasteners 328 may be formed with the prong housing 320 as an integral part. In other embodiments, the fasteners 328 may include separate components that are attachable to the upper surface of the prong housing 320. The fasteners 328 may take on a variety of shapes as appropriate to facilitate the mating of the prong housing 320 and the bottom surface of the upper cover 310. For example, in some embodiments, the fasteners 328 may form a female component, as shown in FIG. 3B, that can selectively receive a male component (e.g., of the fasteners 316 of the upper cover 310 as shown in FIG. 3D). In other embodiments, the fasteners 328 may form a male component configured to selectively mate with a female component.

The support wall 327 may extend along a portion of the first tree trunk section 110 and have a diameter slightly larger than that of the first tree trunk section 110. In this configuration, the support wall 327 may stabilize the alignment and/or position of the prong housing 320 relative to the first tree trunk section 110. As shown in FIG. 3B, the one or more notches 329 may form a small cutout of the support wall 327 that can receive and direct wiring within the male component 300. In some embodiments, each notch 329 may be rectangular and size to receive two or more wires. In other embodiments, multiple notches 329 may be sized and positioned to receive a single wire. In further embodiments, each notch 329 may be substantially U-shaped with curved inner edges.

Disposed partially within the prong housing 320, the inner and outer prongs 330I, 330O may include a threaded section 332 and a smooth section 334. In some embodiments, as shown more clearly in FIG. 3C, the threaded section 332 of the inner and outer prongs 330I, 330O may have a larger portion disposed within their respective prong housings 320O and 320I than not, while the smooth section 334 substantially protrudes from bottom surface of the prong housing 320 (also shown in FIG. 3D). The threaded section 332 may be configured to maintain a position of the inner and outer prongs 330I, 330O within the prong housing 320. The smooth section 334 may be configured to smoothly glide along the surface of the outer and inner contact rings 220, 230 such that the male component 300 maintains electrical communication with the female component 200 regardless of their rotational alignment.

Figure 6A:
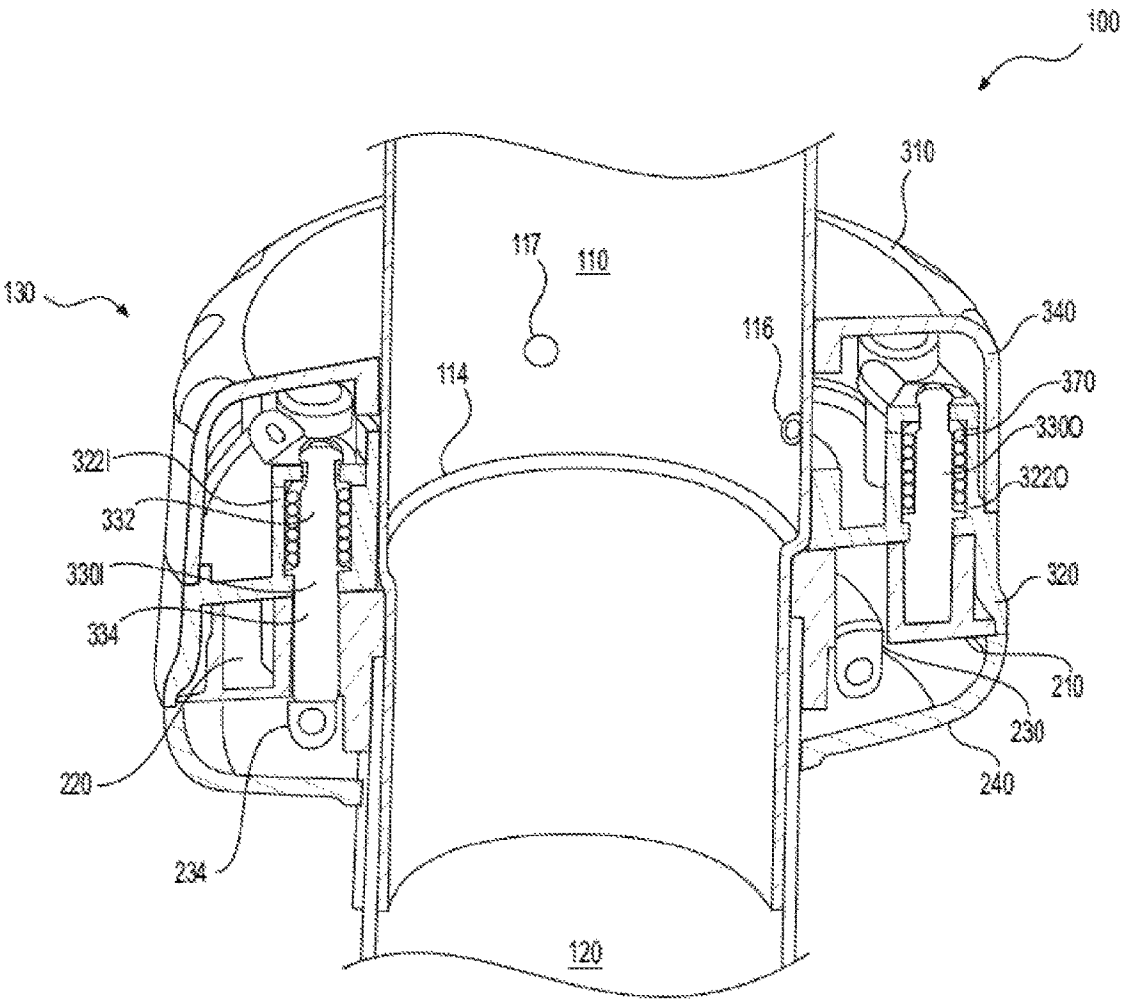
FIG. 6A depicts a cross-sectional perspective view of a female end of a tree trunk section being joined with a male end of a tree trunk section having stabilizer screw holes and spring-loaded prongs, in accordance with some embodiments of the present disclosure.

Some embodiments may incorporate one or more springs 370 to load both the inner and outer prongs 330I, 330O as shown in, for example, FIG. 6A. As will be appreciated, in such embodiments, the springs 370 can compress, thus allowing the prongs 330I, 330O to move further into the male component 300. Upon connecting the male and female components 300, 200, if either prong 330I, 330O becomes pressed against the associated contact ring 230, 220, the associated spring 370 may compress. As will be appreciated, while not necessary, such embodiments can provide improved mechanical connection between the male and female components 300, 200, improved electrical connection between the inner prong 330I and the inner contact ring 230, improved electrical connection between the outer prong 330O and the outer contact rings 220, increased durability of the prongs, increased durability of the contact rings 230, 220, and increased durability of the coupling 130.

Figure 3C:
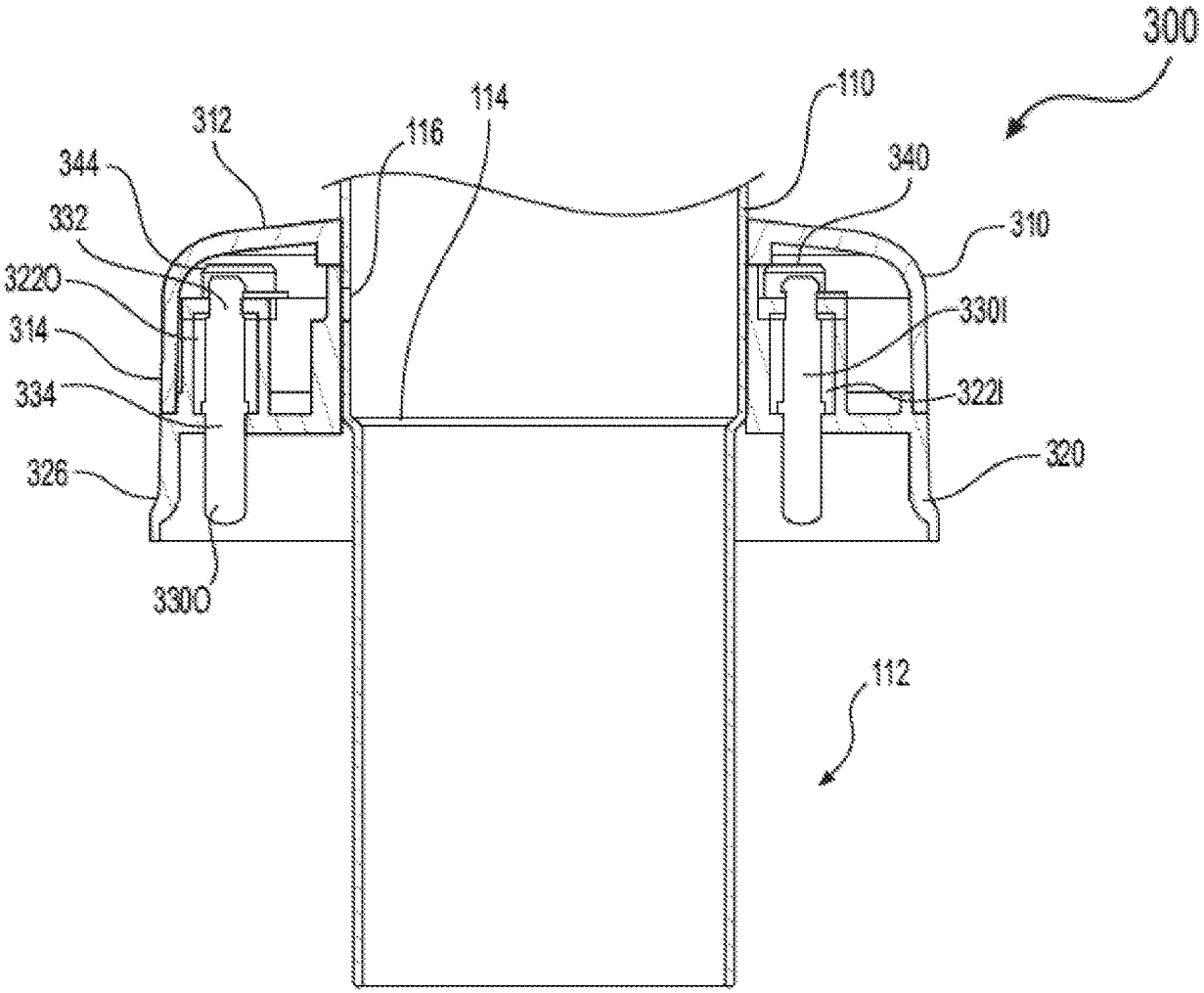
FIG. 3C depicts a cross-sectional side view of a male end of a tree trunk section, in accordance with some embodiments of the present disclosure.
Figure 3D:
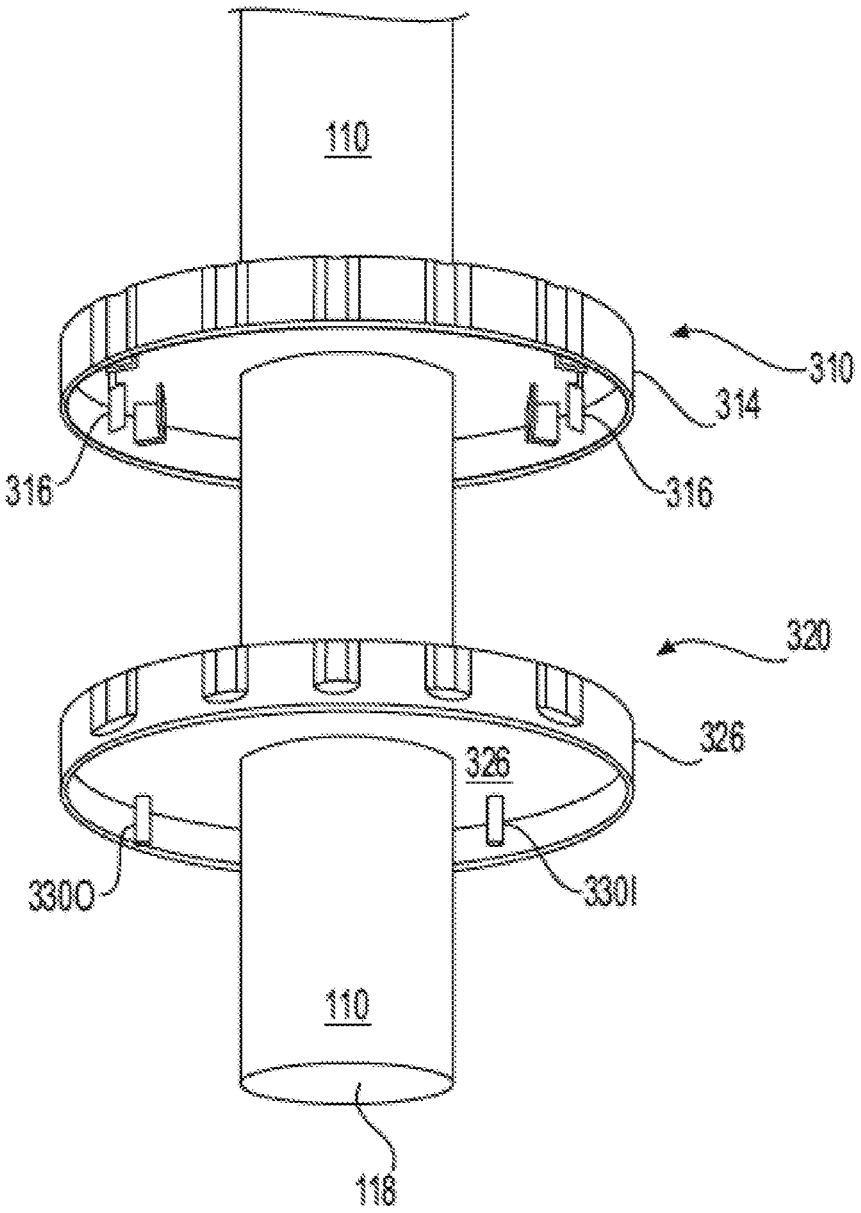
FIG. 3D depicts a perspective bottom view of a disassembled male end of a tree trunk section, in accordance with some embodiments of the present disclosure.
Figure 3E:
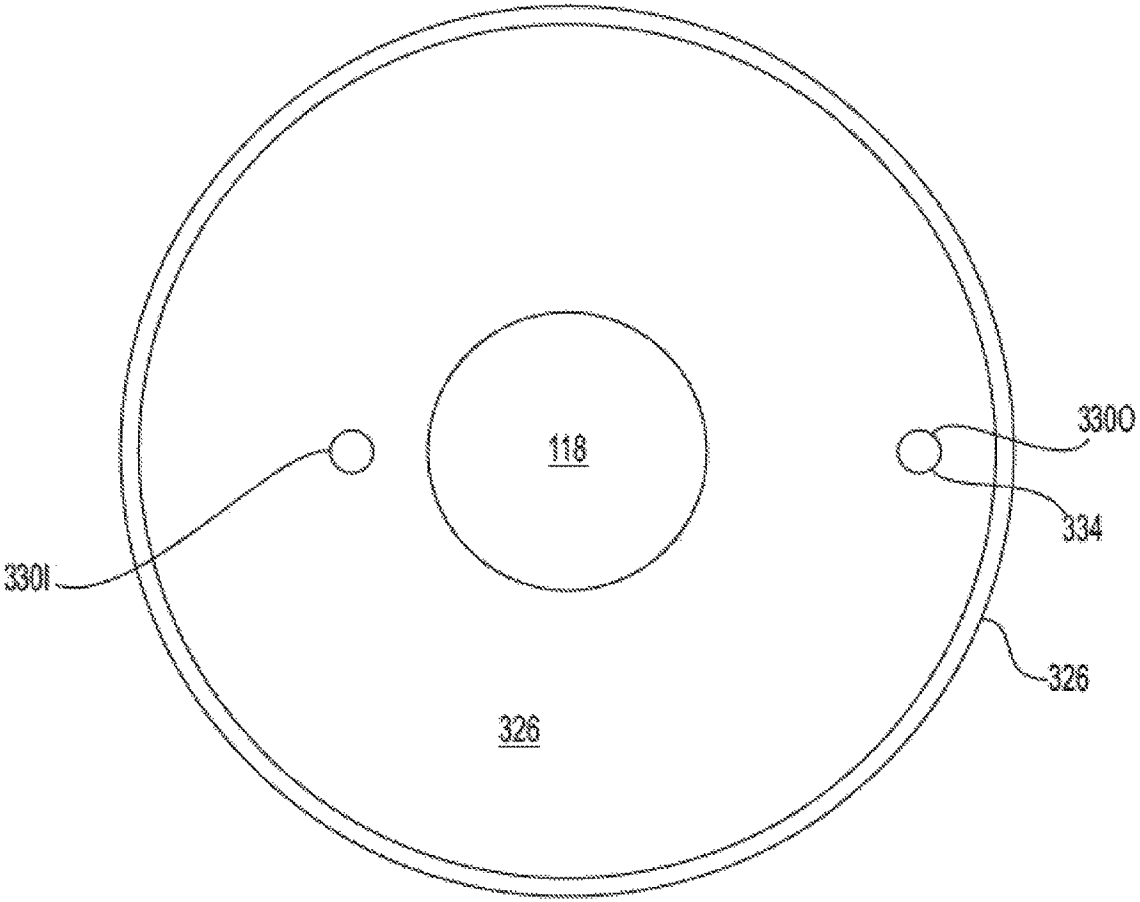
FIG. 3E depicts a bottom view of a prong housing on a male end of a tree trunk section, in accordance with some embodiments of the present disclosure.

As shown in FIGS. 3C-3E, the inner prong 330I may be positioned closer to the center of the prong housing 320 than the outer prong 330O, such that the inner prong 330I is configured to contact the inner contact ring 230 and the outer prong 330O is configured to contact the outer contact ring 220 when the female and male components 200, 300 mate. One of the inner and outer prongs 330I, 330O may provide a "positive" flow path for electricity while the other provides a "negative" flow path for electricity.

Similar to the second tree trunk section 120, the first tree trunk section 110 may have several features to help assist between the mating of the male and female components 200, 300. For example, as shown in FIG. 3B, the first tree trunk section 110 may include a ridge 114 that separates the tapered portion (proximate the male end 112) from the non-tapered portion of the first tree trunk section 110. When the first and second tree trunk sections 110, 120 mate (e.g., when the tapered portion of the male end 112 is inserted into the female end 122), the ridge 114 may abut the one or more dimples 124 of the second tree trunk section 120.

Figure 4A:
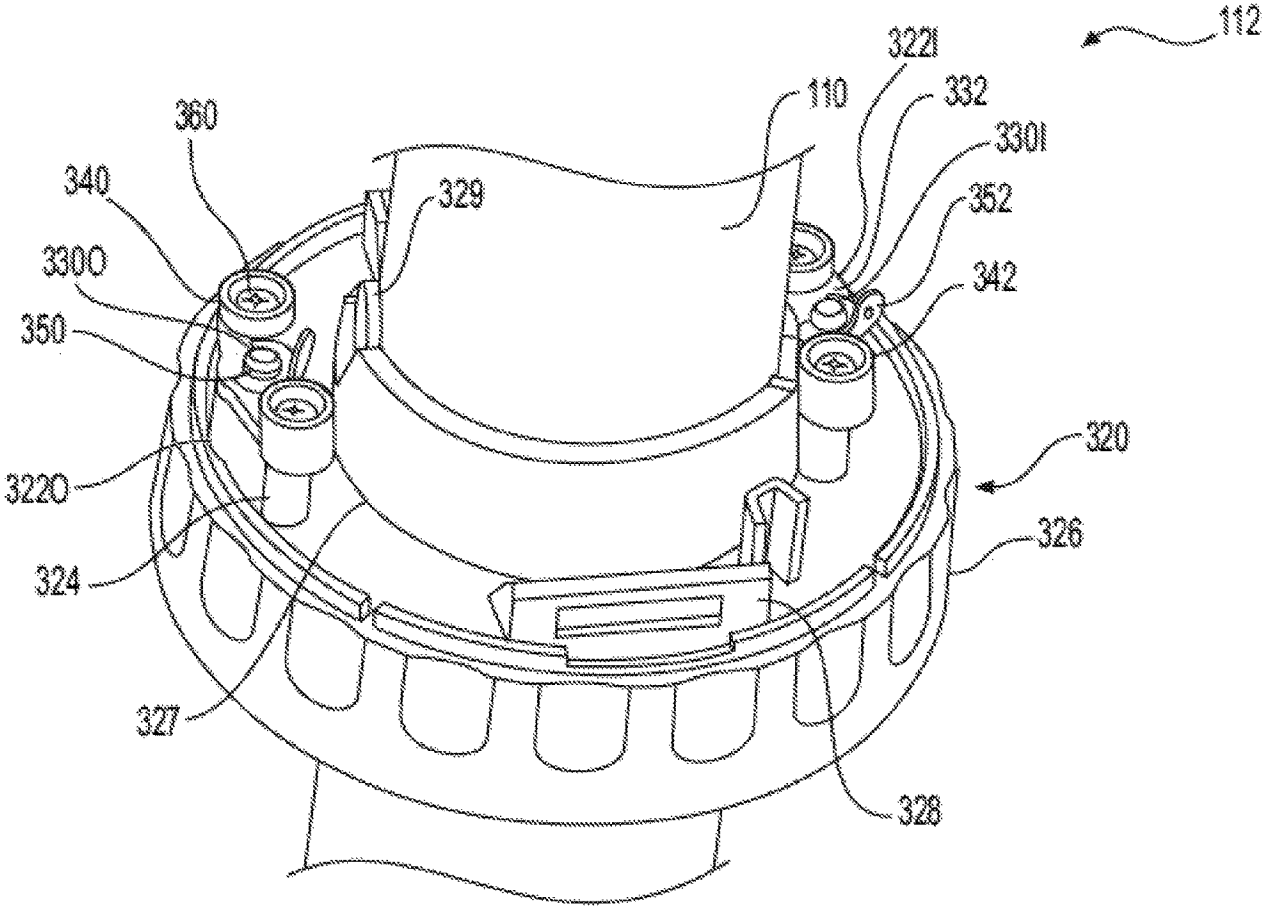
FIG. 4A depicts a perspective top view of an unwired prong housing on a male end of a tree trunk section, in accordance with some embodiments of the present disclosure.
Figure 4B:
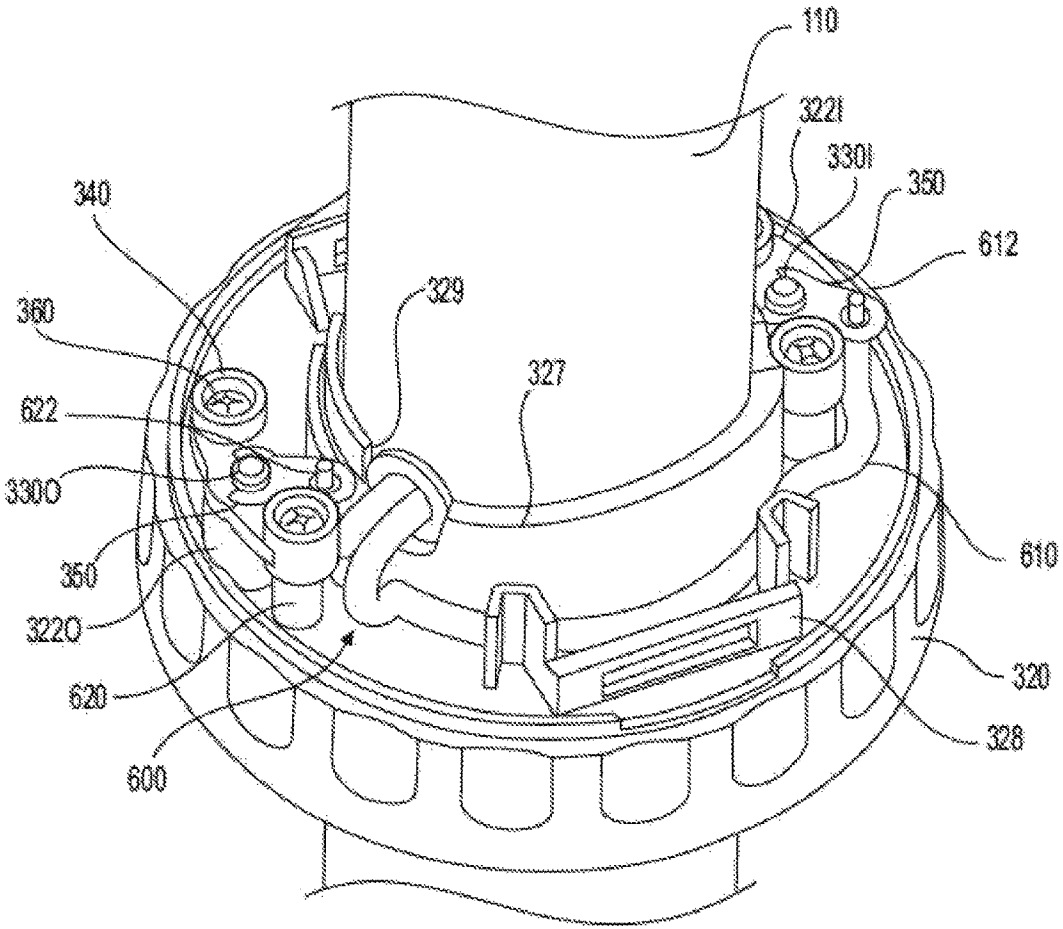
FIG. 4B depicts a perspective top view of a wired prong housing on a male end of a tree trunk section, in accordance with some embodiments of the present disclosure.

The first tree trunk section 110 may also include one or more apertures 116 configured to allow wiring 600 to enter or exit the side of the first tree trunk section 110. FIGS. 4A and 4B show the top of the prong housing 320 without and with wiring 600, respectively, in accordance with some embodiments. The wiring 600 may include two or more electrical wires. In some embodiments, the wiring 600 may include a first wire 610 and a second wire 620, which each may be disposed within the first tree trunk section 110, emerge through the first tree trunk section 110 and the notch 329 of the support wall 327, partially circle around the top surface of the prong housing 320, and connect with the electrical connectors 350. That is, one of the first and second wires 610, 620 may provide a "positive" flow path for electricity while the other provides a "negative" flow path for electricity to the inner and outer prongs 330I, 330O. As shown in FIG. 4B, the first wire 610 may have an exposed tip 612 that extends through an aperture in the electrical connector 350 associated with the inner prong 330I. The exposed tip 612 and the electrical connector 350 may be soldered or otherwise affixed to one another, such that the first wire 610 and electrical connector 350 may pass electricity to the inner prong 330I. The second wire 620 may have an exposed tip 622 that extends through an aperture in the electrical connector 350 associated with the outer prong 330O. The exposed tip 622 and the electrical connector 350 may be soldered or otherwise affixed to one another, such that the second wire 620 and electrical connector 350 may pass electricity to the outer prong 330O.

In practice, electrical current may flow from an external power source (e.g., a wall outlet or battery) through the wiring 500 of the second tree trunk section 120 to the outer and inner contact rings 220, 230 and to the inner and outer prongs 330I, 330O. As shown in more detail in FIG. 4B, the wiring 600 of the first tree trunk section 110 may receive electrical current from the inner and outer prongs 330I, 330O and pass it on to one or more electrical power outlets 150 disposed along the length of the first tree trunk section 110 and/or to another set of inner and outer contact rings associated with another female component (proximate the female end of the first tree trunk section 110, not shown). The wires 610, 620 may enter the first tree trunk section 110 through the aperture 116 without exiting the coupling 130, as shown in FIG. 6C, in some embodiments such that the wiring 600 is contained within the male component 300 and the first tree trunk section 110 collectively to protect the wiring 600 from the external environment. In other embodiments, the wires 610, 620 may enter the first tree trunk section 110 above the male component 300. Regardless of the path of the wires 610, 620 extending away from the inner and outer prongs 330I, 330O, when the female and male components 200, 300 of the coupling 130 are engaged, the outer and inner contact rings 220, 230 may be configured to pass the electrical current to the inner and outer prongs 330I, 330O and on to the wiring 600 disposed within the first tree trunk section 110. The wiring 600 may also be in electrical communication with one or more electrical power outlets 150 positioned along the first tree trunk section 110, such that the wiring 600 could provide power to a string of lights plugged into an electrical power outlet 150 on the first tree trunk section 110.

Figure 6B:
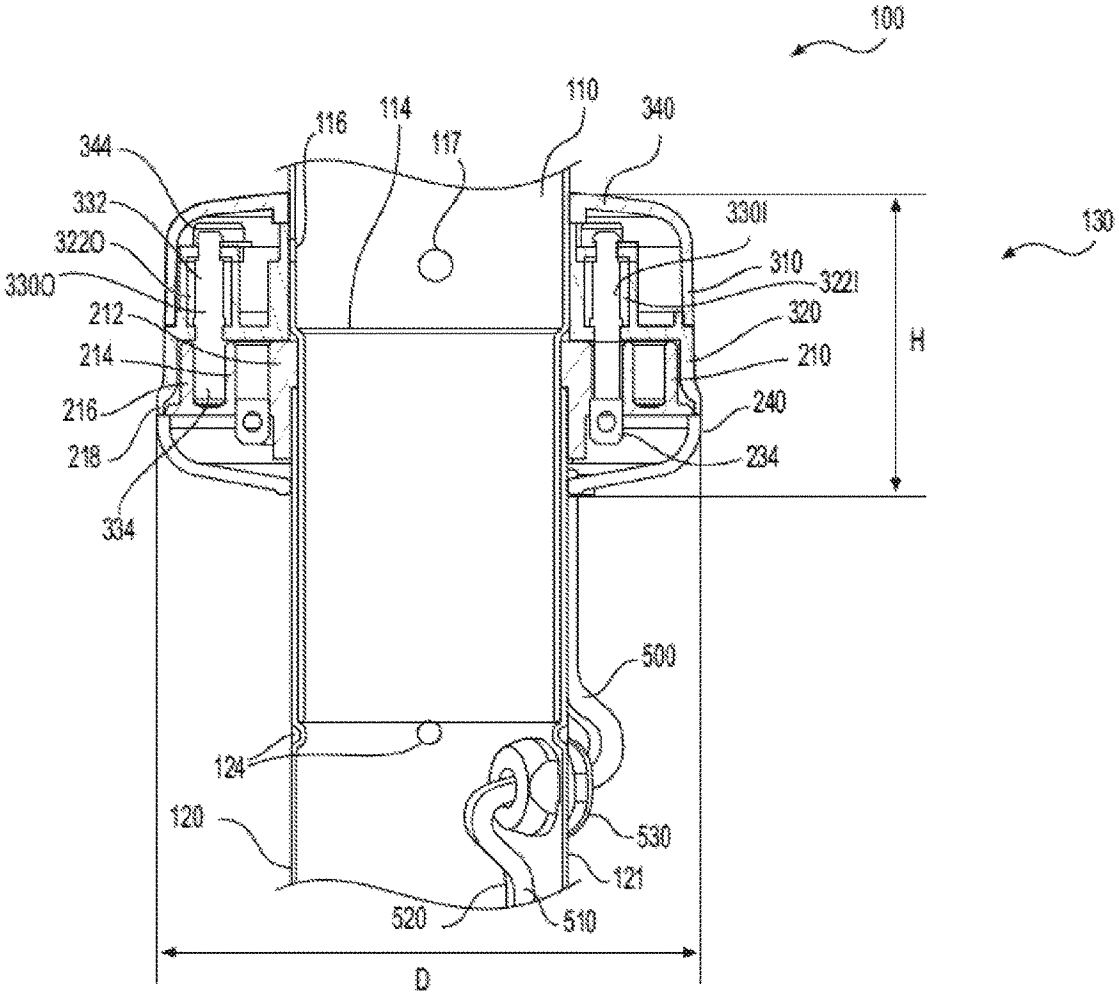
FIG. 6B depicts a cross-sectional side view of a female end of a tree trunk section being joined with a male end of a tree trunk section having stabilizer screw holes, in accordance with some embodiments of the present disclosure.
Figure 6C:
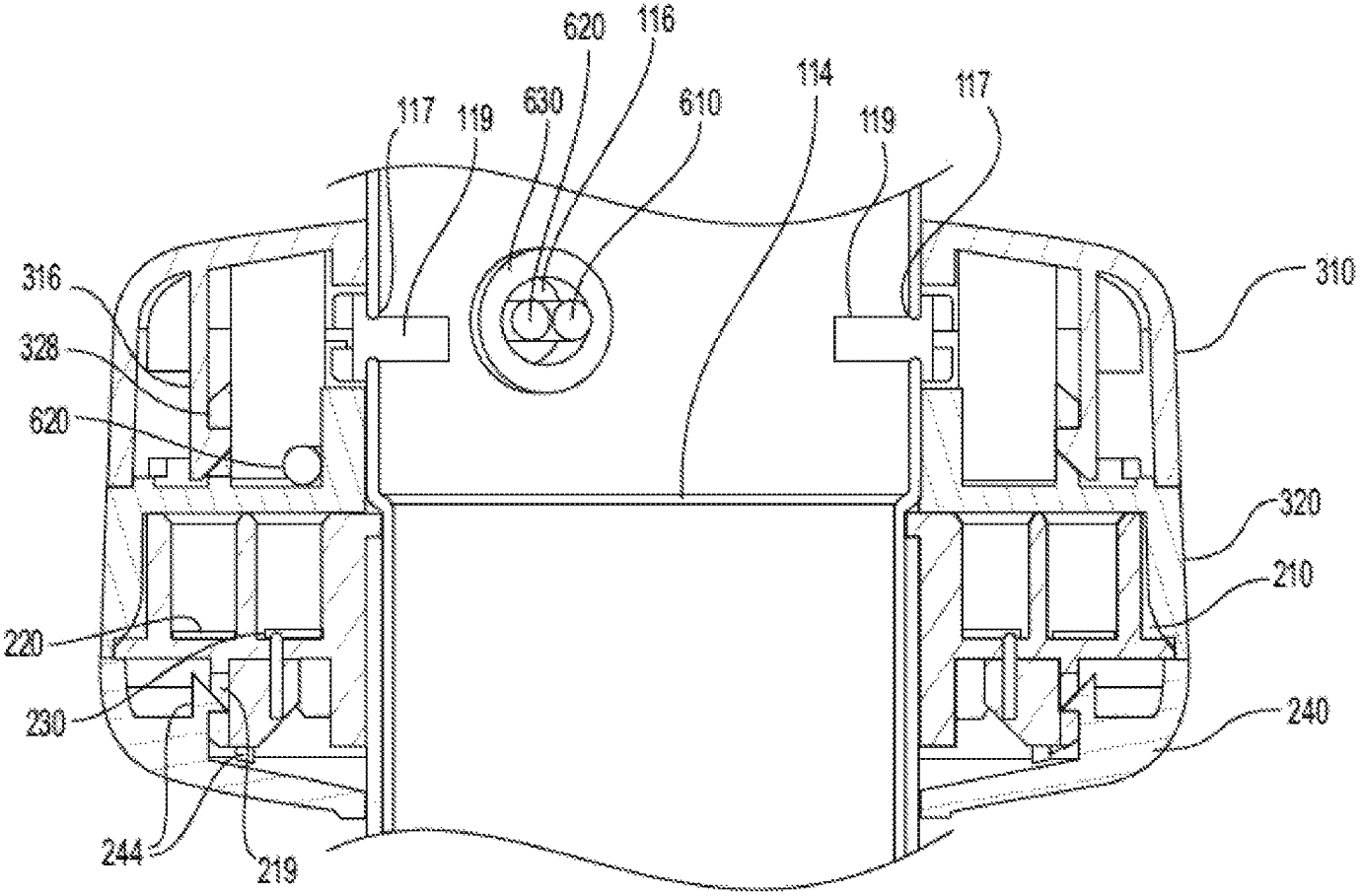
FIG. 6C depicts a cross-sectional side view of a female end of a tree trunk section being joined with a wired male end of a tree trunk section having stabilizer screws, in accordance with some embodiments of the present disclosure.

The female and male components 200, 300 may be configured to mate to form the coupling 130, as shown in different cross-section views in FIGS. 6A-6C. The tapered section of the male end 112 of the first tree trunk section 110 may be insertable into the female end 122 of the second tree trunk section 120 and abut the dimples 124. As shown in FIGS. 6A and 6B, the tabs 234 of the inner contact ring 230 downwardly extend from the channel housing 210. At different cross-section views, the tabs 224 of the outer contact ring 220 may also visibly extend from the channel housing 210, as shown in FIG. 2D. The inner prong 330I may be configured to contact the inner contact ring 230, and the outer prong 330O may be configured to contact the outer contact ring 220 in the outer channel, regardless of the rotational alignment of the first and second tree trunk sections 110, 120 in the vertical axis, such that the male end 112 of a power distribution subsystem disposed in the first tree trunk section 110 may receive power from, or distribute power to, the female end 122 of a power distribution subsystem disposed in the second tree trunk section 120. In this manner, the tree trunk sections can be coupled via the couplings 130 to provide electrical current to electrical power outlets 150 positioned along the tree trunk sections, and thus, strings of lights may be plugged into the electrical power outlets 150 and powered. The tree trunk sections may be connected to one another regardless of their rotational alignment relative to one another. That is, regardless of how the first tree trunk section 110 is rotated in the vertical axis relative to the second tree trunk section 120, the inner and outer prongs 330I, 330O may remain in contact (and thus, in electrical communication) with the inner and outer contact channels 230, 220 and the first and second tree trunk sections 110, 120 remain in electrical communication.

The lower cover 240, the prong housing 320, and the upper cover 310 may collectively form the external wall of the joined female and male components 200, 300, thereby protecting the exposed electronics from the external environment. The prong housing 320 and the channel housing 210 may abut the lower cover 240, which may help prevent the channel housing 210 from "floating" within the coupling 130 rather than maintaining its position relative to, and electrical communication with, the prong housing 320.

While FIGS. 6A and 6B show opposing views of the inner and outer prongs 330I, 330O contacting the outer and inner contact rings 220, 230, FIG. 6C shows more detail of the mechanical connection between the upper cover 310 and the prong housing 320, and the lower cover 240 and the channel housing 210. For example, the fasteners 316 extending from the bottom surface of the upper cover 310 may be configured to mate with the fasteners 328 extending from the upper surface of the prong housing 320 (exploded view shown in FIG. 3B). Similarly, the fasteners 219 extending from the bottom surface of the channel housing 210 may be configured to mate with the fasteners 244 upwardly extending from the lower cover 240.

Figure 6D:
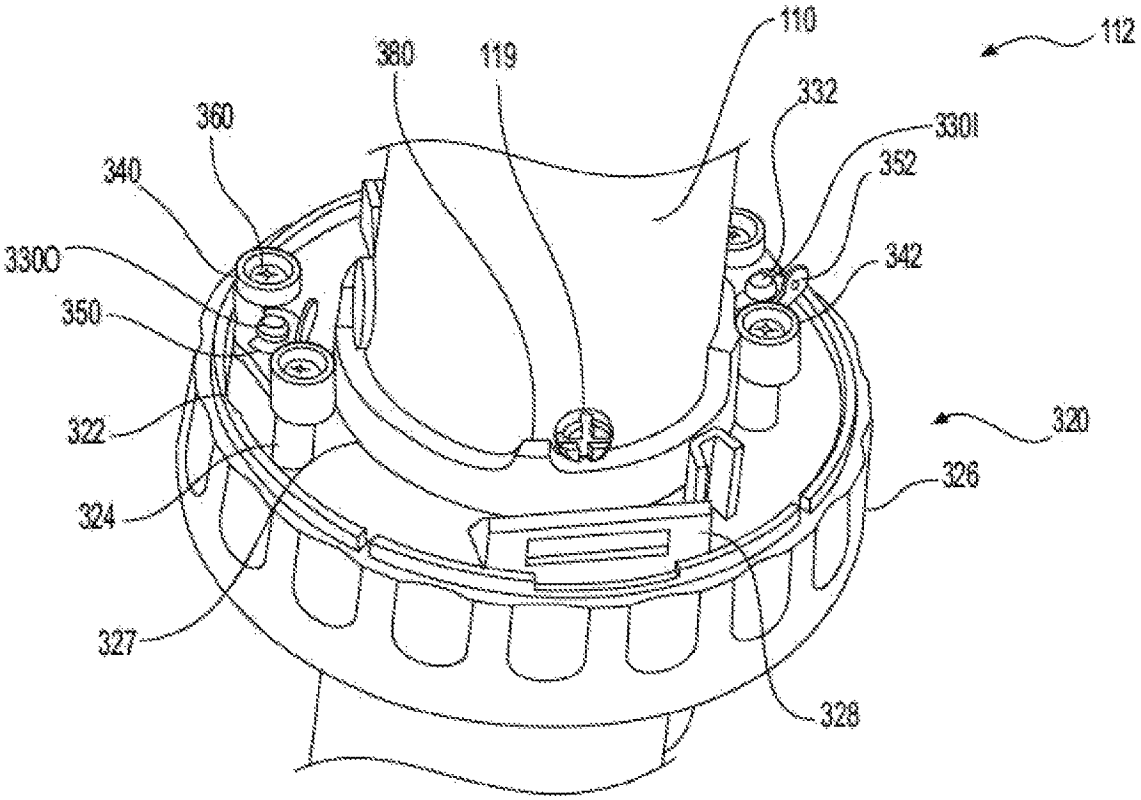
FIG. 6D depicts a perspective top view of an unwired prong housing on a male end of a tree trunk section having stabilizer screws, in accordance with some embodiments of the present disclosure.

In some embodiments, as shown in FIGS. 6A, 6C, and 6D, the first tree trunk section 110 may include one or more support apertures 117 that allow a support bolt 119 to pass through. In this configuration, the support bolt 119 may help maintain a rotational alignment of the prong housing 320 with the first tree trunk section 110. In some embodiments, as shown in FIG. 6D, the support wall 327 of the prong housing 320 may have one or more ridges configured to abut the support bolt 119. In other embodiments, the support wall 327 may include one or more support apertures (not shown), such that the support bolt 119 may extend through the support apertures and the support apertures 117 of the first tree trunk section 110. In some embodiments, a pair of support bolts 119 may be used (as shown in FIG. 6C). In other embodiments, a single support bolt 119 may be used (as shown in FIGS. 6D and 7A).

In another embodiment, as shown in FIGS. 7A and 7B, the outer wall 242 of the lower cover 240 may be steeper such that the height H' of the coupling 130 is greater than the height H of the embodiment shown in FIG. 6B to provide additional clearance for the wiring 500, 600 or other components of the coupling 130. With each embodiment of the coupling 130, it is contemplated that the wiring 500, 600 may remain within the coupling 130 to pass directly back into the tree trunk 100. For example, the female end 122 of the second tree trunk section may include an aperture 121 configured to allow the wiring 500 to pass from the tabs 224, 234 directly into the second tree trunk section 120 without being exposed to the external environment. When inserted, the tapered section of the male end 112 ends above the aperture 121 in the female end 122 of the second tree trunk section. The female end 122 of the second tree trunk section may also include dimples such that the male end 112 may not be inserted past the dimples. The male end 112 may include a ridge 114 such that the male end 112 may not be inserted farther than the ridge 114 would mechanically allow. A non-tapered portion 111 of the male end 112 of the first tree trunk section 110 may still include the aperture 116 configured to allow the wiring 600 to pass directly from the electrical connectors 350 and the inner and outer prongs 330I, 330O into the first tree trunk section 110 without being exposed to the external environment.

Figure 8A:
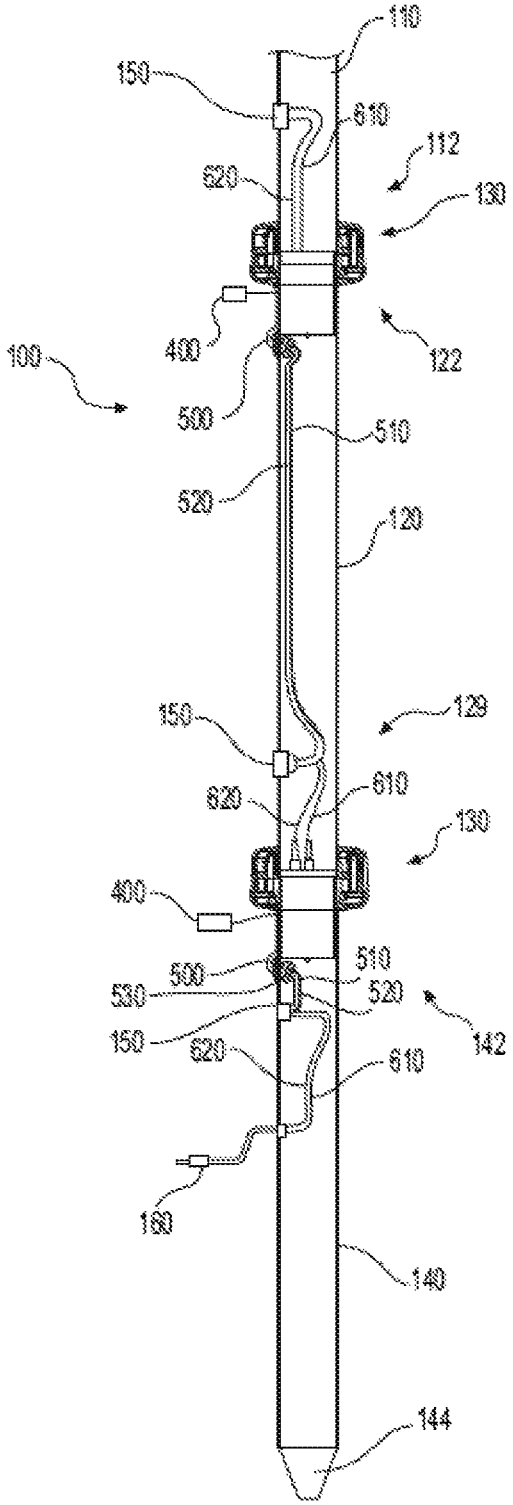
FIG. 8A depicts a cross-sectional side view of assembled tree trunk sections having power distribution subsystems, in accordance with some embodiments of the present disclosure.

FIG. 8A depicts a cross-section view of an exemplary embodiment of an assembled tree trunk 100. As shown, the male end 112 of the first tree trunk section 110 may be configured to mate with the female end 122 of the second tree trunk section 120 via the coupling 130. The second tree trunk section 120 may also include a male end 129 opposite the female end 122, and the male end 129 may be configured to mate with a female end 142 of a third tree trunk section 140 via another coupling 130 (and so on, as there may be any number of tree trunk sections to create a tree of any size). In this configuration, power distribution subsystems disposed in different tree trunk sections 110, 120, 140, etc. of the tree trunk 100 may be electrically connected. The first tree trunk section 110 may have wires 610 and 620 disposed within, which may be connected to inner and outer prongs 330I, 330O of the male component 300 of the coupling 130. The outer and inner contact rings 220, 230 proximal to the female end 122 of the second tree trunk section may be configured to pass a flow of electricity from the wires 510 and 520 to the inner and outer prongs 330I, 330O proximal to the male end 112 of the first tree trunk section where the wires 510 and 520 are partially disposed within the second tree trunk section 120. Likewise the outer and inner contact rings 220, 230 proximal to the female end 142 of the third tree trunk section may be configured to pass a flow of electricity from the wires 510 and 520 to the inner and outer prongs 330I, 330O proximal to the male end 129 of the of the second tree trunk section where the wires 510 and 520 are partially disposed within the third tree trunk section 140. Extending away from the coupling 130, the wires 510 and 520 may be configured to pass a flow of electricity to one or more electrical power outlets 150, and be connected to additional wires 610 and 620. Proximate the lowest tree trunk section (as shown, the third tree trunk section 140), a power cord 160 may extend from the tree trunk 100 and be connectable to a power source (e.g., a wall outlet). Thus, the wires 510, 520, 610, and 620, as part of the power distribution subsystems, may enable power to flow from a power source through the tree and to certain pluggable accessories, such as a one or more lights or strands of lights. The lights or strands of lights can therefore be illuminated when power is supplied to the tree via the power cord 160.

The one or more electrical power outlets 150, which may be provided along the length of the assembled tree trunk 100, may be configured to receive power from wires 510, 520, 610, or 620 to provide a user with the ability to plug in devices, such as tree lights or other electrical components. By providing a convenient location to plug in lights, electrical power outlets 150 can minimize the amount of effort required to decorate a tree. More specifically, a user can plug a strand of lights directly into an electrical power outlet 150 on a trunk section 100, instead of having to connect a series of strands together, which can be cumbersome and frustrating for a user.

Embodiments of the present disclosure can further comprise strands of lights that are unitarily integrated with the power transfer system. Thus, the lights can be connected to the wires 510, 520, 610, or 620 without the need for electrical power outlets 150, although the electrical power outlets 150 can be optionally included. Such embodiments can be desirable for trees that come pre-strung with lights, for example.

In some embodiments, one or more sections of the tree trunk 100 can include the power cord 160 for receiving power from an outside power source, such as a wall outlet. The power cord 160 may be configured to engage a power source and distribute power to the rest of the tree. More specifically, power can flow from the wall outlet, through the power cord 160, through the one or more power distribution subsystems disposed within the tree trunk 100, and to accessories on the tree, such as lights or strands of lights. In some embodiments, the power cord 160 can be located on a lower trunk section 100 of the tree for reasons of convenience and appearance, i.e., the power cord 160 is close to the wall outlets and exits the tree at a location that is not immediately visible.

Figure 8B:
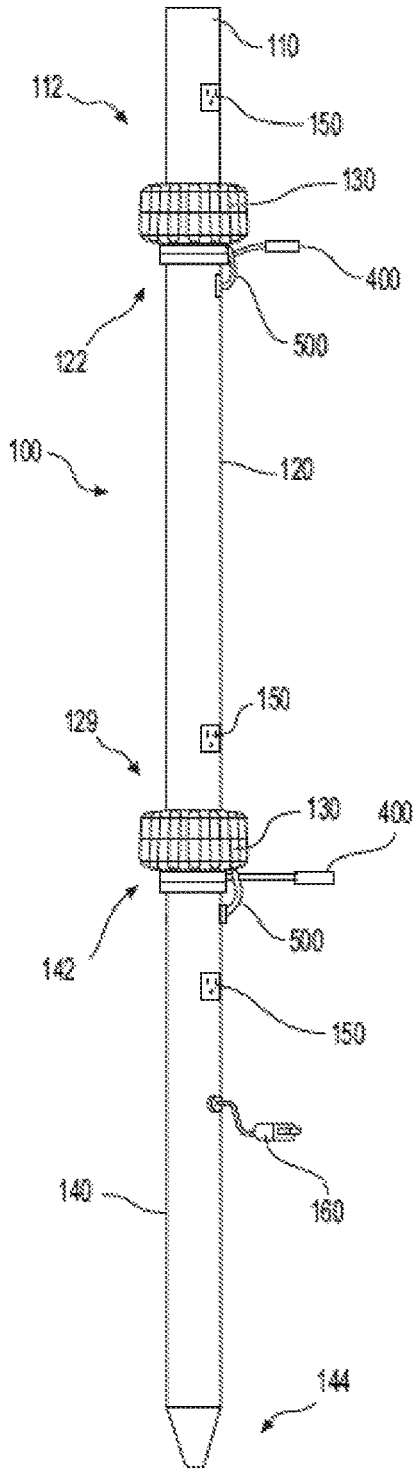
FIG. 8B depicts a side view of assembled tree trunk sections having power distribution subsystems, in accordance with some embodiments of the present disclosure.

Embodiments of the present disclosure can also comprise a bottom section 144 of one or more trunk sections (e.g., the bottommost tree trunk section) of the tree trunk 100. As shown in FIGS. 8A and 8B, the bottommost tree trunk section (e.g., the third tree trunk section 140) has a female end 142 proximate its top end, and the bottom section 144 in lieu of a male end at its bottom end. The bottom section 144 can be substantially conical in shape, and can be configured to engage a stand for the tree (not shown). Accordingly, the bottom section 144 can be inserted into the stand, and the stand can support the tree, usually in a substantially vertical position. Correspondingly, the uppermost tree trunk section of the tree trunk 100 (e.g., the first tree trunk section 110) may have a male end 112 proximate its bottom end and may not have a female end proximate its top end. Instead of having a female end, the top end of an uppermost tree trunk section may be configured to resemble an upper portion of a tree or attachably receive a top cover that resembles an upper portion of a tree.

In some embodiments, it can be advantageous for a lowest trunk section 140 of a tree trunk 100 to comprise a female end 142 of a power distribution subsystem. During assembly, a male end 129 of a power distribution subsystem of a neighboring trunk section 120 can be joined with the female end 142 of the lowest trunk section 140. This can improve safety during assembly because the exposed male prongs are not energized, i.e., they do not have electricity flowing through them until they are inserted into the female end 142. To the contrary, if the lowest trunk section comprises a male end, energized prongs can be exposed, and accidental electrical shock can result. Ideally, the power cord 160 may not be plugged into a wall outlet until the tree is fully assembled, but embodiments of the present disclosure are designed to minimize the risk of injury if the tree is plugged in prematurely.

In addition, in some embodiments, all of the trunk sections can be configured so that the male end 112, 129 may be proximate a bottom end of each trunk section, and the female end 122, 142 is the top end. In this manner, if the power cord 160 is plugged in during assembly, the risk of injury is minimized because energized male prongs are not exposed. Further, it may be easier to stack the male end 112, 129 of each trunk section into the female end 122, 142 of the lower tree trunk section during assembly. In alternate embodiments, however, the male end 112, 129 may be proximate a top end of each trunk section, and the female end 122, 142 may be proximate a bottom end of each trunk section.

FIG. 8B is an external, side view of an assembled tree trunk according to various embodiments of the present disclosure. Three tree trunk sections 110, 120, 140 are assembled and physically connected to one another to support the tree. As discussed previously, it can be desirable to use a sleeve system to secure one tree trunk section 100 to another tree trunk section 100, with the tapered section of each male end 112, 129 inserting into a larger diameter female end 122, 142 of the neighboring tree trunk section. The electrical power outlets 150 and the power cord 160 are also shown.

Figure 9:
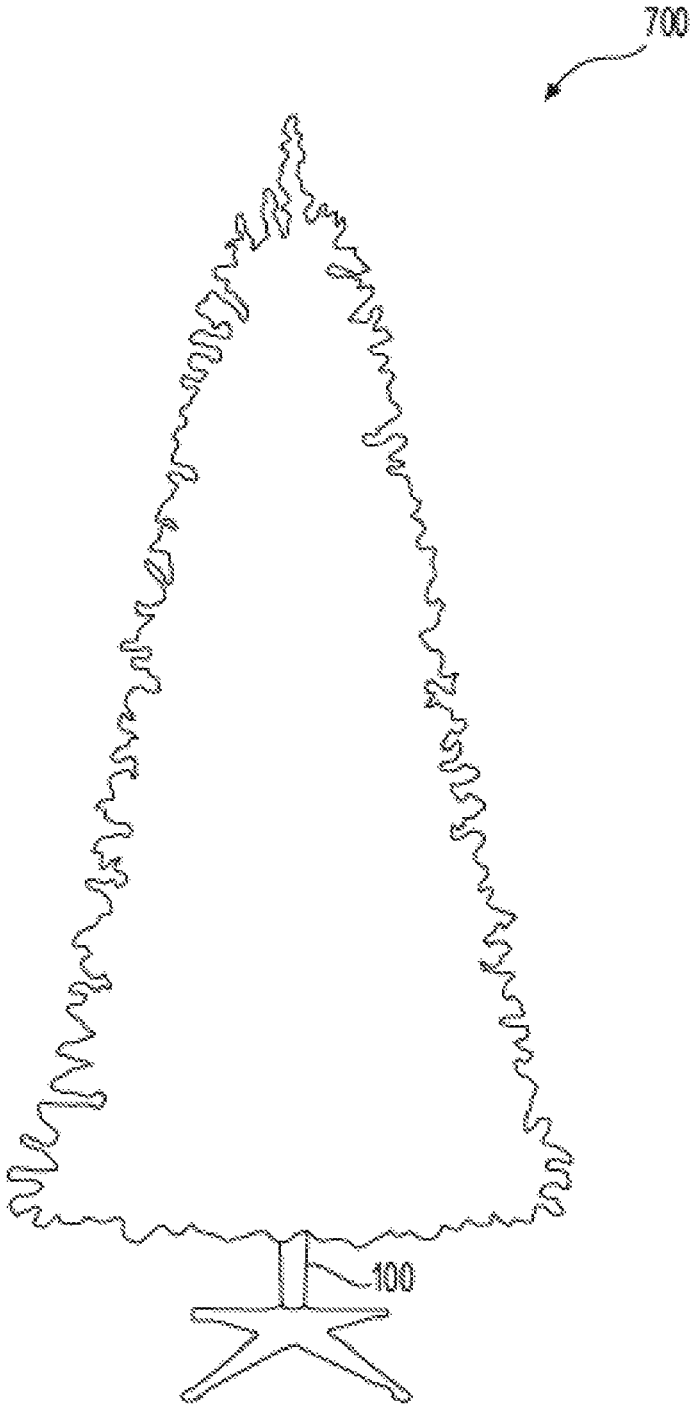
FIG. 9 depicts an assembled artificial Christmas tree, in accordance with some embodiments of the present disclosure.

FIG. 9 shows an assembled tree 700 in accordance with some embodiments of the present disclosure. The tree 700 may have been assembled by electrically connecting various sections of the tree trunk 100 as described herein, and can be been decorated as desired with electronic and non-electronic decorations. A person having skill in the art would understand that the assembled tree trunk sections 100 may be positioned proximate the central vertical axis of the tree 700, that a plurality of branches may attach to the tree trunk sections 100 to resemble a natural tree, and that lights may be strung on or in (or otherwise attached to) the branches to decorate the tree 700.

While the present disclosure has been described in connection with a plurality of exemplary aspects, as illustrated in the various figures and discussed above, it is understood that other similar aspects can be used or modifications and additions can be made to the described aspects for performing the same function of the present disclosure without deviating therefrom. For example, in various aspects of the disclosure, methods and compositions were described according to aspects of the presently disclosed subject matter. However, other equivalent methods or composition to these described aspects are also contemplated by the teachings herein. Therefore, the present disclosure should not be limited to any single aspect, but rather construed in breadth and scope in accordance with the appended claims.

What is claimed is:

1. An artificial tree system comprising:

a plurality of tree trunk sections, including a first tree trunk section and a second tree trunk section, each respective tree trunk section having an elongate body, a first end, and a second end, wherein the first end of the first tree trunk section can be mechanically connected to the second end of the second tree trunk section about a vertical axis to form a body of the artificial tree system;

a first power distribution subsystem disposed at least in part within the first tree trunk section, the first power distribution comprising an inner prong and an outer prong;

a second power distribution subsystem disposed at least in part within the second tree trunk section, the second power distribution comprising an inner contact ring and an outer contact ring; and a coupling comprising:

a female component mechanically attachable to the second tree trunk section, the second power distribution subsystem being disposed at least partially within the female component; and a male component mechanically attachable to the first tree trunk section, the first power distribution subsystem being disposed at least partially within the male component, wherein the female component is configured to receive the male component to facilitate electrical communication between the first power distribution subsystem and the second power distribution subsystem by a contacting of (i) the inner prong to the inner contact ring and (ii) the outer prong to the outer contact ring, and wherein the female component is further configured to receive the male component independent of the rotational alignment about the vertical axis of the male component in relation to the female component.

2. The artificial tree system of claim 1, wherein:

the female component comprises a channel housing having an inner wall, a middle wall, and an outer wall, each wall being proximal to an upper surface of the channel housing, wherein the inner contact ring is disposed at least partially between the inner wall and middle wall, and the outer contact ring is disposed at least partially between the middle wall and outer wall.

3. The artificial tree system of claim 2, the female component further comprising a lower cover attachable to a bottom surface of the channel housing, the lower cover configurable to contain and shield electronic components disposed within the female component.

4. The artificial tree system of claim 2 further comprising a detachably attachable safety cover proximate the female component and configurable to be receivable by the female component when the female component is not receiving the male component.

5. The artificial tree system of claim 1, wherein:

the inner contact ring further comprises a substantially flat circular surface and one or more tabs extending away from the flat surface, the one or more tabs configured to provide electrical connection between the flat surface and one or more wires; and the outer contact ring further comprising a substantially flat circular surface and one or more tabs extending away from the flat surface, the one or more tabs configured to provide electrical connection between the flat surface and one or more wires.

6. The artificial tree system of claim 1, the male component further comprising a prong housing, the inner prong and the outer prong being disposed at least partially within the prong housing, and the prong housing comprising:

a plurality of prong cavities, each prong cavity configurable to hold the inner prong or the outer prong in place; and a support wall extending upward from an upper surface of the prong housing, the support wall configured to abut an outer wall of one of the plurality of tree trunk sections, the support wall configured to stabilize or align the prong housing relative to the tree trunk section.

7. The artificial tree system of claim 6, the male component further comprising an upper cover detachably attachable to the upper surface of the prong housing and configurable to shield electronic components disposed within the male component.

8. The artificial tree system of claim 6, the inner prong and the outer prong each comprising a smooth section and a threaded section, the threaded section of each prong disposed at least partially within the prong housing, and the smooth portion of each prong protruding from the bottom surface of the prong housing.

9. The artificial tree system of claim 6, the prong housing further comprising a first electrical connector configured for connecting the outer prong to a first wire, and a second electrical connector configured for connecting the inner prong to a second wire, the first second wires being components of one of the plurality of power distribution subsystems.

10. The artificial tree system of claim 1, the male component further comprising an outer wall characterized by a plurality of shapes, providing a surface for an assembler of the tree to grip when mechanically connecting the first end of the first tree trunk section to the second end of the second tree trunk section about a vertical axis to form a body of the artificial tree system.

11. The artificial tree system of claim 1 further comprising a power cord extendable from one of the plurality of tree trunk sections, the power cord being connectable to a power source for providing electricity to one or more of the plurality of power distribution subsystems.

12. The artificial tree system of claim 1, wherein one or more of the plurality of power distribution subsystems are configured to provide electrical power to accessories on the tree.

13. The artificial tree system of claim 1, further comprising an electrical power outlet configured to receive electrical power from one of the plurality of power distribution subsystems and further configured to provide electrical power to a pluggable accessory.

14. The artificial tree system of claim 1, wherein the female component is secured to the second tree trunk section such that the female component does not rotate about the vertical axis in relation to the second tree trunk section; and wherein the male component is secured to the first tree trunk section such that the male component does not rotate about the vertical axis in relation to the first tree trunk section.

15. The artificial tree system of claim 1, wherein one or more of the plurality of tree trunk sections comprises an aperture for passing one or more electrical wires from an interior of the respective tree trunk section to an exterior of the respective tree trunk section.

16. An artificial tree system comprising:

a plurality of tree trunk sections, including a first tree trunk section and a second tree trunk section, each respective tree trunk section having an elongate body, a first end, and a second end, wherein the first end of the first tree trunk section includes an extended portion that can be inserted into to the second end of the second tree trunk section about a vertical axis to form a body of the artificial tree system;

a plurality of power distribution subsystems, wherein one or more of the plurality of power distribution subsystems are configured to provide electrical power to accessories on the tree, wherein a first power distribution subsystem is disposed at least in part within the first tree trunk section and a second power distribution subsystem is disposed at least in part within the second tree trunk section, wherein the first tree trunk section includes a first aperture configured to allow one or more wires to pass from the outside of the first tree trunk section to the inside of the first tree trunk section, and wherein the second tree trunk section includes a second aperture configured to allow one or more wires to pass from the outside of the second tree trunk section to the inside of the second tree trunk section;

a coupling comprising a circular female component secured to the second tree trunk section such that the female component does not rotate about the vertical axis in relation to the second tree trunk section; and a circular male component secured to the first tree trunk section such that the male component does not rotate about the vertical axis in relation to the first tree trunk section, wherein the circular female component is substantially outside of the second tree trunk section and the circular male component is substantially outside of the first tree trunk section, wherein the female component includes an inner contact ring having a larger diameter than the second tree trunk section and an outer contact ring having a larger diameter than the inner contact ring, the inner contact ring and the outer contact ring both being in electrical communication with the second power distribution subsystem, wherein the male component includes an inner prong located within a first prong cavity within a prong housing and an outer prong located within a second prong cavity within the prong housing, the inner prong and the outer prong both being in electrical communication with the first power distribution subsystem, wherein the female component is configured to receive the male component to facilitate electrical communication between the first power distribution subsystem and the second power distribution subsystem, and wherein the female component is further configured to receive the male component independent of the rotational alignment about the vertical axis of the male component in relation to the female component; and a power cord extendable from one of the plurality of tree trunk sections, the power cord being connectable to a power source for providing electricity to one or more of the plurality of power distribution subsystems.

* * * * *